US007989390B2

(12) United States Patent
Narita et al.

(10) Patent No.: US 7,989,390 B2
(45) **Date of Patent: *Aug. 2, 2011**

(54) METHOD FOR FLUORESCENT IMAGE FORMATION, PRINT PRODUCED THEREBY AND THERMAL TRANSFER SHEET THEREOF

(75) Inventors: Satoshi Narita, Tokyo (JP); Koji Eto, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 95 days.

This patent is subject to a terminal disclaimer.

(21) Appl. No.: 12/320,728

(22) Filed: Feb. 3, 2009

(65) Prior Publication Data

US 2009/0148787 A1 Jun. 11, 2009

Related U.S. Application Data

(62) Division of application No. 11/126,364, filed on May 11, 2005, now Pat. No. 7,504,190, which is a division of application No. 10/173,023, filed on Jun. 18, 2002, now Pat. No. 7,005,166.

(30) Foreign Application Priority Data

Jun. 19, 2001 (JP) ..... 2001-185595
Jun. 19, 2001 (JP) ..... 2001-185669
Jul. 18, 2001 (JP) ..... 2001-217738

(51) Int. Cl.
*B41M 5/035* (2006.01)
*B41M 5/50* (2006.01)

(52) U.S. Cl. ..... 503/227

(58) Field of Classification Search ..... None
See application file for complete search history.

(56) References Cited

U.S. PATENT DOCUMENTS 5,516,590 A 5/1996 Olmstead et al.
6,541,100 B1 * 4/2003 Williams et al. ..... 428/195.1
7,504,190 B2 * 3/2009 Narita et al. ..... 430/200

FOREIGN PATENT DOCUMENTS

EP 0 982 149 A1 3/2000
EP 1 013 463 A2 6/2000
JP A-63-089384 4/1988
WO WO 89/10268 11/1989

* cited by examiner

*Primary Examiner* — Bruce H Hess
(74) *Attorney, Agent, or Firm* — Oliff & Berridge, PLC

(57) ABSTRACT

The present invention relates to a method for fluorescent image formation which can form a highly scratch-resistant fluorescent full-color image using a colorless fluorescent agent and can freely regulate the tone of color mixture of a combination of two or more fluorescent colors in order to impart, to articles, a higher level of forgery preventive function than a prior art technique and a print having a high level of forgery preventive function. The invention characterized in that fluorescent inks are provided that are substantially colorless upon visible light irradiation and contain organic fluorescent agents which, upon ultraviolet light irradiation, emit fluorescences in a visible region, and that two or more fluorescent inks, which emit fluorescences having mutually different color tones, are deposited on a printing face in its image formation region according to information on an image to be printed in a dot matrix manner so that dots of one color do not overlap with dots of another color.

6 Claims, 3 Drawing Sheets

METHOD FOR FLUORESCENT IMAGE FORMATION, PRINT PRODUCED THEREBY AND THERMAL TRANSFER SHEET THEREOF

This is a Division of application Ser. No. 11/126,364 filed May 11, 2005, which in turn is a Division of application Ser. No. 10/173,023 filed Jun. 18, 2002, which claims priority to JP 2001-185595 filed Jun. 19, 2001, JP 2001-185669 filed Jun. 19, 2001, and JP 2001-217738 filed Jul. 18, 2001. The disclosures of the prior applications are hereby incorporated by reference herein in their entirety.

BACKGROUND OF THE INVENTION

1. Technical Field

The present invention relates to a thermal transfer sheet, in which a fluorescent agent has been incorporated for preventing the forgery/alteration of important papers, such as securities and paper money, and cards, such as ID cards and credit cards, and other articles having great asset values, or for improving the level of design and amusement, a thermal transfer method using said sheet, and a print produced using the same. More particularly, the present invention relates to a thermal transfer sheet that can produce a print which emits fluorescence with higher intensity and emits a more complicate fluorescent color and thus is difficult to forge and alter.

2. Prior Art

Various methods for preventing the forgery of securities, paper money, ID cards, credit cards and the like are known. Examples thereof include a method wherein fine characters or color figure patterns, which make copying difficult, are printed, a method wherein characters or images are formed using a transfer foil of gold or silver, which cannot be reproduced by three primary colors, or special colorants such as inks having a pastel tone or a pearl tone and fluorescent color inks, and a method wherein a hologram image, which can be formed only by an advanced production technique, is provided.

Further, a method has also been adopted wherein an image, which cannot be visually perceived under usual service environment, is formed using a fluorescent agent which does not substantially absorb visible light and is substantially colorless or white under visible light, but on the other hand, emits visible fluorescence upon the application of ultraviolet light, and the print is inspected with an ultraviolet lamp or the like for the presence of the fluorescent image to judge whether or not the print is genuine.

Japanese Patent Laid-Open No. 111800/1987 discloses a thermal transfer sheet using the above fluorescent agent. Further, Japanese Patent Laid-Open No. 207452/1996 discloses a thermal transfer sheet wherein thermally transferable dye layers of three primary colors of red, blue, green or four colors of the three primary colors and black and, in addition, a fluorescent color transfer layer containing a thermally transferable fluorescent dye have been provided in a mutually partitioned form on a continuous sheet.

In the prior art techniques, however, even when a fluorescent agent, which does not substantially absorb visible light and is substantially colorless or white under visible light, but on the other hand, emits visible fluorescence upon ultraviolet irradiation, is used, the forgery of the print is primarily possible by using quite or substantially the same colorant. In fact, color tones of currently known colorless fluorescent agents are roughly classified into three colors of red, blue, and green. For each color, color tones of fluorescent agents are similar to each other or one another even when they have been produced by different manufacturers. For example, for colorless fluorescent agents which emit red light, the emission wavelength is generally around 615 nm. Therefore, even for an identical color, it is difficult to visually distinguish one fluorescent agent from another fluorescent agent. For this reason, when a similar colorless fluorescent agent is available, the print can be in some cases forged without the use of the colorless fluorescent agent per se used in the "genuine print."

Japanese Patent Laid-Open No. 125403/1995 discloses a method for forming a printed image which emits three or more fluorescent colors upon exposure to ultraviolet light, wherein images of two or more inks are printed, by thermal ink transfer using inks containing a fluorescent pigment or a fluorescent dye as a colorant which emits light upon exposure to ultraviolet light, on an object so as to partially overlap with each other.

Further, Japanese Patent Laid-Open No. 158823/2000 discloses a method for printing a fluorescent full-color image using a thermo-fusible (hot-melt) transfer sheet comprising inorganic colorless fluorescent agent transfer layers of a plurality of colors.

In these methods, however, since inks of a plurality of colors are printed so as to be superimposed on top of each other for the formation of a fluorescent full-color image, a multilayered structure of ink layers is formed on a part of the printing face. This poses a problem of deteriorated scratch resistance of the printed image.

Further, in the portion where the ink layers of a plurality of colors have been superimposed on top of each other, the quantity of ultraviolet light, which reaches the lower ink layer, is smaller than the quantity of ultraviolet light which reaches the upper ink layer. This results in lowered emission ability on the lower ink layer side and thus disadvantageously makes it difficult to regulate the color tone as desired by mixing of fluorescent colors.

SUMMARY OF THE INVENTION

Accordingly, an object of the present invention is to provide a method for fluorescent image formation, which, in order to impart a higher level of forgery preventive function than the prior art techniques using colorless fluorescent agents, can form a highly scratch-resistant fluorescent full-color image and can regulate the color tone, obtained by color mixing of a combination of two or more fluorescent colors, as desired, and a print which has a high level of forgery preventive function.

The above object can be attained by a method for fluorescent image formation, adapted for the formation of an image which, upon exposure to ultraviolet light irradiation, emits a plurality of fluorescent colors and/or a fluorescent color as a mixture of said plurality of fluorescent colors, said method comprising the steps of: providing two or more fluorescent inks respectively containing an organic fluorescent agents which are substantially colorless upon visible light irradiation, but on the other hand, emit fluorescences having mutually different color tones in a visible region upon ultraviolet irradiation; and depositing two or more fluorescent inks according to information on an image to be printed in a dot matrix manner onto a printing face in its image formation region so that dots of one color do not overlap with dots of another color. According to this method, the above problems can be solved including a problem that, upon overprinting of fluorescent inks of a plurality of colors, superimposition of the ink layers of a plurality of colors onto top of each other leads to deteriorated scratch resistance and a problem that, upon overprinting of fluorescent inks of a plurality of colors, the quantity of ultraviolet light, which reaches the lower ink layer, is smaller than the quantity of ultraviolet light which reaches the upper ink layer and this results in lowered emission ability on the lower ink layer side and thus disadvantageously makes it difficult to control the color tone as desired by mixing of fluorescent colors. Specifically, color mixing is carried out by the so-called "area gradation" wherein fluorescent inks of individual colors are deposited in a dot matrix manner so that dots of one color do not overlap with dots of another color, and the tone of the fluorescent color is controlled by varying the area ratio of the color dot groups. Therefore, there is no portion where the ink layers have been superimposed. Consequently, neither a deterioration in scratch resistance derived from the superimposition of the ink layers on top of each other nor a deterioration in emission ability of the lower ink layer derived from the superimposition of the ink layers on top of each other takes place. This can facilitate the control of the tone of the fluorescent color and thus can impart a high level of forgery preventive property to the print.

In a preferred embodiment of the present invention as described above, there is provided a method for image formation that can print two or more fluorescent colors and can form an image which, upon exposure to ultraviolet light, emits a plurality of fluorescent colors and/or a fluorescent color as a mixture of the plurality of fluorescent colors. This method comprises the steps of: coating two or more thermo-fusible fluorescent inks, which emit fluorescences having mutually different color tones, respectively onto the surface of separate substrate film surfaces, thereby providing a plurality of thermal transfer sheets; putting one of the plurality of thermal transfer sheets onto a printing face so that the thermo-fusible fluorescent ink layer faces the printing face in its image formation region; heating the thermo-fusible fluorescent ink layer in the thermal transfer sheet put on top of the printing face according to information on an image to be printed to thermally transfer the thermo-fusible ink layer onto the image formation region in a dot matrix manner so that the formed dots do not overlap with dots of another color which have previously been formed or are to be formed; separating, by the thermal transfer, the thermo-fusible ink layer from the thermal transfer sheet to transfer the thermo-fusible ink layer onto the printing face; and then successively transferring thermo-fusible fluorescent ink layers respectively in the other thermal transfer sheets in the same manner as in the above step onto the same image formation region in which the thermo-fusible ink layer has been thermally transferred.

In another preferred embodiment of the above invention, there is provided a method for image formation that can print two or more fluorescent colors and can form an image which, upon exposure to ultraviolet light, emits a plurality of fluorescent colors and/or a fluorescent color as a mixture of the plurality of fluorescent colors. This method comprises the steps of: successively coating two or more thermo-fusible fluorescent inks, which emit fluorescences having mutually different color tones, onto the surface of identical substrate film to successively form the plurality of thermo-fusible fluorescent ink layers onto the identical substrate film surface, thereby providing a thermal transfer sheet; putting the thermal transfer sheet on top of a printing face so that one of the thermo-fusible fluorescent ink layer faces the printing face in its image formation region; heating the thermo-fusible fluorescent ink layer in the thermal transfer sheet put on top of the printing face according to information on an image to be printed to thermally transfer the thermo-fusible fluorescent ink layer onto the image formation region in a dot matrix manner so that the formed dots do not overlap with dots of another color which have previously been formed or are to be formed; separating, by the thermal transfer, the thermo-fusible ink layer from the thermal transfer sheet to transfer the thermo-fusible ink layer onto the printing face; and then successively transferring other thermo-fusible fluorescent ink layers in the thermal transfer sheet in the same manner as in the above step onto the same image formation region in which the thermo-fusible ink layer has been thermally transferred.

Further, according to a preferred embodiment, in the above thermal transfer sheet, the thermo-fusible fluorescent ink layer and, in addition, one or two or more of a colorant transfer layer, a thermo-fusible black ink layer, and a transferable protective layer are provided in a face serial manner, and this thermal transfer sheet is used to thermally transfer a fluorescent image and, in addition, one or two or more of an image, which can be visually perceived upon exposure to visible light, a visible image of black ink, and a transferable protective layer. For example, a thermal sublimation transferable dye layer or a thermal ink transferable thermo-fusible ink layer may be provided as the colorant transfer layer. Further, two or more of yellow (Y), magenta (M), cyan (C) and other color tones may be provided as the colorant transfer layer in a face serial relationship with other transfer layers.

Further, the above object can be attained by the second method for fluorescent image formation. The second method for image formation comprises the step of thermally transferring two or more organic fluorescent agents, which are substantially colorless upon exposure to visible light, but on the other hand, emit fluorescences different from each other in color tone upon exposure to ultraviolet light, onto a printing face in its image formation region by thermal dye sublimation transfer according to information on an image to be printed. According to this method, in performing thermal dye sublimation transfer using organic colorless fluorescent agents, even when overprinting is adopted rather than the dot matrix method, a high level of forgery preventive property as attained in the first method can be imparted to prints.

More specifically, according to the second method of the present invention, upon the thermal transfer, the matrix in the dye layer stays on the thermal transfer sheet, and only the colorless fluorescent agent is sublimated and is diffused into the printing face. Therefore, the colorless fluorescent agent diffused into the printing face has excellent invisibility under visible light, and, thus, it is difficult to find the fact that printing has been performed using a fluorescent agent.

Further, in the second method according to the present invention, only the colorless fluorescent agent is thermally diffused into the printing face, and even in overprinting two or more colors, the superimposed structure of inks is not formed. Therefore, neither a deterioration in scratch resistance derived from the superimposition of the ink layers on top of each other nor a deterioration in emission ability of the lower ink layer derived from the superimposition of the ink layers on top of each other takes place.

Further, the amount of the thermally transferred colorless fluorescent agent can be regulated on a desired level by varying the heating energy. The use of a combination of colorless fluorescent agents, which emit fluorescences different from each other in color tone, can realize the emission of desired fluorescent colors having various color tones including white. Further, in this case, the tone of the fluorescent color produced by color mixing can be infinitely varied. Thus, also in the second method, as with the first method, a gradational full-color fluorescent color image can be formed.

In a preferred embodiment of the second method for image formation according to the present invention, there is provided a method for image formation that can print two or more fluorescent colors and can form an image which, upon exposure to ultraviolet light, emits a plurality of fluorescent colors and/or a fluorescent color as a mixture of the plurality of fluorescent colors. This method comprises the steps of: providing a plurality of thermal transfer sheets, each comprising a substrate film and, provided on the surface of the substrate film, a fluorescent dye layer which emits fluorescence having color tone different from that of fluorescence emitted by a fluorescent dye layer in other thermal transfer sheet(s); putting one of the plurality of thermal transfer sheets on top of a printing face so that the fluorescent dye layer faces the printing face in its image formation region; heating the fluorescent dye layer in the thermal transfer sheet put on top of the printing face according to information on an image to be printed to thermally diffuse the organic fluorescent agent into the image formation region; separating, by the thermal diffusion, the fluorescent dye layer from the thermal transfer sheet to thermally transfer the fluorescent dye layer onto the printing face; and then successively thermally diffusing organic fluorescent agents in respective other thermal transfer sheets in the same manner as in the above step onto the same image formation region where the fluorescent dye layer has been thermally transferred.

In another preferred embodiment of the second method for image formation, there is provided a method for image formation that can print two or more fluorescent colors and can form an image which, upon exposure to ultraviolet light, emits a plurality of fluorescent colors and/or a fluorescent color as a mixture of the plurality of fluorescent colors. This method comprises the steps of: providing a thermal transfer sheet comprising a substrate film and, provided on substrate film in its identical surface in a face serial manner, two or more fluorescent dye layers which emit fluorescences different from each other in color tone; putting one of the plurality of fluorescent dye layers on top of a printing face so that the fluorescent dye layer faces the printing face in its image formation region; heating the fluorescent dye layer in the thermal transfer sheet put on top of the printing face according to information on an image to be printed to thermally diffuse the organic fluorescent agent into the image formation region; separating, by the thermal diffusion, the fluorescent dye layer from the thermal transfer sheet to thermally transfer the fluorescent dye layer onto the printing face; and then successively thermally diffusing organic fluorescent agents in respective other fluorescent dye layers in the thermal transfer sheet in the same manner as in the above step onto the same image formation region where the fluorescent dye layer has been thermally transferred.

Further, according to a preferred embodiment, in the above thermal transfer sheet, the fluorescent dye layer and, in addition, one or two or more of a colorant transfer layer, a thermo-fusible black ink layer, and a transferable protective layer are provided in a face serial manner, and this thermal transfer sheet is used to thermally transfer a fluorescent image and, in addition, one or two or more of an image, which can be visually perceived upon exposure to visible light, a visible image of black ink, and a protective layer. For example, a thermal sublimation transferable dye layer or a thermal ink transferable thermo-fusible ink layer may be provided as the colorant transfer layer. Further, two or more colors selected from yellow (Y), magenta (M), cyan (C) and other color tones may be properly provided as the colorant transfer layer in a face serial relationship with other transfer layers.

Further, the above object can be attained by a first thermal transfer sheet comprising: a substrate film; and, provided on the surface of the substrate film, a transfer layer containing a plurality of organic fluorescent agents, which are substantially colorless upon exposure to visible light, but on the other hand, emit fluorescences in different visible regions upon exposure to ultraviolet light. In a preferred embodiment of the thermal transfer sheet according to the present invention, regarding the fluorescent color transfer layer, for example, a thermal ink transfer fluorescent ink layer may be used to thermally transfer the fluorescent agents together with the ink, or alternatively, a thermal dye sublimation transfer fluorescent dye layer may be used to thermally transfer only the fluorescent agents. Further, in another preferred embodiment, in the above thermal transfer sheet, the fluorescent color transfer layer and, in addition, one or two or more of a colorant transfer layer, a thermo-fusible black ink layer, and a transferable protective layer are provided in a face serial manner, and this thermal transfer sheet is used to thermally transfer a fluorescent image and, in addition, one or two or more of an image, which can be visually perceived upon exposure to visible light, a visible image of black ink, and a transferable protective layer.

Further, the above object of the present invention can be attained by a second thermal transfer sheet comprising: a substrate film; and, provided on one side of the substrate film in the following order, a release layer, an intermediate layer, and a heat-sensitive colored layer, said intermediate layer and said heat-sensitive colored layer containing fluorescent agents which, upon ultraviolet light irradiation, emit fluorescence in a visible region. The addition of the fluorescent agent to both the intermediate layer and the heat-sensitive adhesive layer in the thermal transfer sheet can enhance the luminance of fluorescence, and the addition of fluorescent agents different from each other in fluorescent color respectively to the intermediate layer and the heat-sensitive adhesive layer can realize the provision of a print which emits more complicate fluorescent colors and has enhanced level of forgery/alteration preventive effect and design.

In a preferred embodiment of the second thermal transfer sheet according to the present invention, upon ultraviolet light irradiation, the fluorescent agents emit fluorescences in visible regions having different color tones. Further, at least one layer selected from the group consisting of sublimable dye layers of one or more colors selected from the group consisting of yellow, magenta, cyan, and black colors and a thermo-fusible black ink layer, and a protective layer may be provided on the surface of the film in a face serial relationship with the intermediate layer and the heat-sensitive colored layer. Furthermore, the intermediate layer and the heat-sensitive colored layer may be formed in a pattern form.

DETAILED DESCRIPTION OF THE INVENTION

The present invention will be described in detail.

First Method for Image Formation

The first method for image formation according to the present invention can be applied to methods for image formation, wherein a colorless fluorescent agent is dissolved and dispersed in a certain matrix to prepare an ink, and the colorless fluorescent agent, together with the ink, is deposited onto a printing face, for example, thermal ink transfer and ink jet recording.

The first method will be described by taking a case, where thermal ink transfer is used, as a representative example.

When the first method according to the present invention is carried out by thermal transfer, a plurality of thermal transfer sheets, wherein thermo-fusible fluorescent ink layers of two or more colors respectively formed of thermo-fusible fluorescent inks containing organic fluorescent agents, which are substantially colorless upon visible light irradiation and emit fluorescences different from each other in color tone upon ultraviolet light irradiation, are provided respectively on separate substrate films, can be used in combination to print two or more fluorescent colors.

In this case, an image, which emits a plurality of fluorescent colors and/or a fluorescent color of a mixture of the plurality of fluorescent colors upon ultraviolet light irradiation, can be formed by putting one of the plurality of thermal transfer sheets on top of a printing face so that the thermo-fusible fluorescent ink layer in the thermal transfer sheet faces the printing face in its image formation region, heating the thermo-fusible fluorescent ink layer according to information on an image to be printed to thermally transfer the thermo-fusible fluorescent ink onto the printing face in its image formation region in a dot matrix manner and in such a manner that the formed dots do not overlap with other color dots which have already been formed or are to be formed, separating the thermo-fusible fluorescent ink layer, and then successively thermally transferring the thermo-fusible fluorescent ink layer in other thermal transfer sheets in the same manner as described above onto the identical image formation region.

Figure 1A:
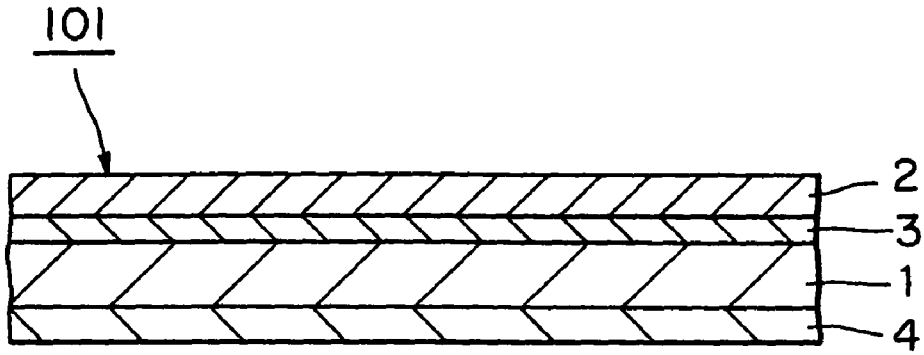
FIG. 1A is a typical cross-sectional view of one embodiment of a thermal transfer sheet usable in the method for image formation according to the present invention.

FIG. 1A is a typical cross-sectional view of an embodiment (101) of a thermal transfer sheet used in the present invention. The thermal transfer sheet 101 has a construction such that a thermo-fusible fluorescent ink layer 2 is provided through a release layer 3 on one side of a substrate film 1 and a heat-resistant layer 4 for preventing sticking to a heating element, such as a thermal head, or for improving slipperiness is provided on the other side of the substrate film 1. The thermo-fusible fluorescent ink layer is formed by dissolving or dispersing any colorless fluorescent agent, such as red (R), blue (B), or green (G), in a thermo-fusible vehicle (matrix) to prepare a solution or a dispersion and coating the solution or dispersion onto a substrate film. Upon heating, the colorless fluorescent agent, together with the thermo-fusible vehicle, can be thermally transferred onto the printing face. Two or more fluorescent colors can be printed using a plurality of thermal transfer sheets which have the construction shown in FIG. 1A and are provided respectively with thermo-fusible fluorescent ink layers each containing a colorless fluorescent agent which emits a color tone different from the color tones of fluorescent agents contained in thermo-fusible fluorescent ink layers in the other thermal transfer sheets.

In the present invention, alternatively, two or more fluorescent colors may be printed using a thermal transfer sheet wherein thermo-fusible fluorescent ink layers of two or more colors respectively formed of thermo-fusible fluorescent inks each containing an organic fluorescent agent, which is substantially colorless upon visible light irradiation and, upon ultraviolet light irradiation, emits fluorescence of a color tone different from that of fluorescence emitted from the fluorescent agent(s) in the other thermo-fusible fluorescent ink layer (s), are provided in a face serial manner on an identical substrate film.

In this case, an image, which emits a plurality of fluorescent colors and/or a fluorescent color of a mixture of the plurality of fluorescent colors upon ultraviolet light irradiation, can be formed by putting one of the thermo-fusible fluorescent ink layers provided in the thermal transfer sheet on top of the printing face so that the thermo-fusible fluorescent ink layer faces the printing face in its image formation region, heating the thermo-fusible fluorescent ink layer according to information on an image to be printed to thermally transfer the thermo-fusible fluorescent ink onto the printing face in its image formation region in a dot matrix manner and in such a manner that the formed dots do not overlap with other color dots which have already been formed or are to be formed, separating the thermo-fusible fluorescent ink layer, and then successively thermally transferring other thermo-fusible fluorescent ink layers in the identical thermal transfer sheet in the same manner as described above onto the identical image formation region.

According to this method wherein two or more fluorescent colors are printed using one thermal transfer sheet, a construction can be adopted wherein thermo-fusible fluorescent ink layers of two or more colors are provided in a face serial manner on a continuous thermal transfer sheet, the continuous thermal transfer sheet is then reeled in a roll form, the roll is mounted on a thermal transfer printer, and a plurality of fluorescent colors are printed from this one reel of the thermal transfer sheet. This construction is effective in reducing printer size and in simplifying printer structure. When a colorant transfer layer, such as a thermo-fusible black ink layer, a sublimable dye layer, or a thermo-fusible ink layer, a transferable protective layer or the like, together with the plurality of thermo-fusible fluorescent ink layers, is provided on the thermal transfer sheet, not only the fluorescent colors but also conventional colorants, which are visible upon visible light irradiation, a protective layer and the like can be transferred onto an identical printing face from the one reel of the thermal transfer sheet. This is effective in further reducing printer size and simplifying printer structure. When a color image, which can be visually perceived upon visible light irradiation, together with the fluorescent color image, is formed on an identical printing face, the step of transferring fluorescent agents by thermo-fusible fluorescent ink layers may be carried out before the step of transferring colorants by colorant transfer layers such as a thermo-fusible black ink layer, a sublimable dye layer, and a thermo-fusible ink layer, or vice versa. Preferably, however, the color image is printed before printing the fluorescent color image, from the viewpoint of preventing the conventional color image from hiding the fluorescent color image.

Figure 1B:
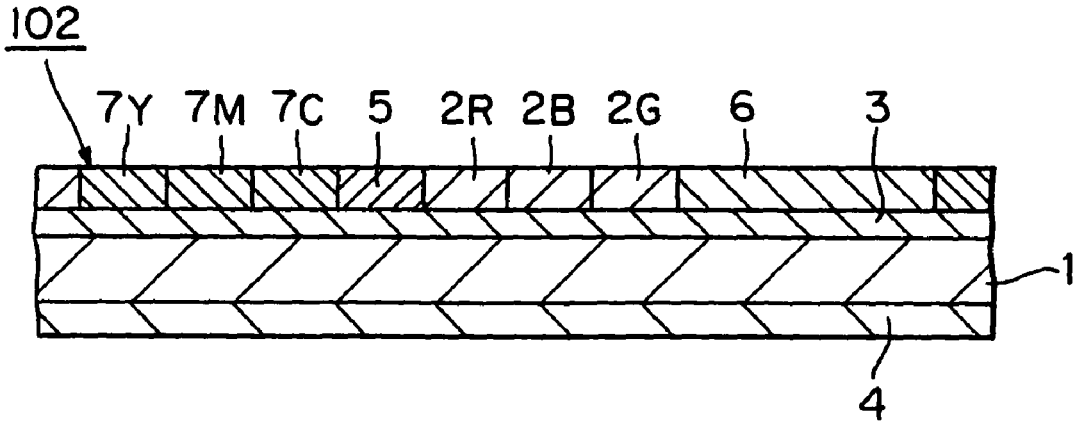
FIG. 1B is a typical cross-sectional view of another embodiment of a thermal transfer sheet usable in the method for image formation according to the present invention.

FIG. 1B is a typical cross-sectional view of one embodiment (102) of a thermal transfer sheet usable in this case. The thermal transfer sheet 102 has a construction such that thermo-fusible ink layers 7 of yellow (Y), magenta (M), and cyan (C) which can be visually perceived upon visible light irradiation (7Y, 7M, 7C), a thermo-fusible black ink layer 5, thermo-fusible fluorescent ink layers 2 of red (R), blue (B), and green (G) (2R, 2B, 2G), and a transferable protective layer 6 are provided in a face serial manner on one side of a substrate film 1, that is, are provided in parallel on an identical substrate film along the direction of feed of the film at the time of thermal transfer.

In the thermal transfer sheet 102 shown in FIG. 1B, the thermo-fusible fluorescent ink layers 2 as well as the thermo-fusible ink layers 7, the thermo-fusible black ink layer 5, and the transferable protective layer 6 are provided on the substrate film through a release layer 3. Further, as with the thermal transfer sheet 101 shown in FIG. 1A, a heat-resistant layer 4 is provided on the backside of the substrate film in the thermal transfer sheet 102.

The substrate film constituting the thermal transfer sheet in the present invention may be formed of a properly selected film material which has heat resistance and film strength high enough to withstand the thermal transfer process. The substrate film used in the conventional thermal transfer sheet may be used in the present invention without any problem. Specific examples of preferred substrate films include: tissue papers, such as glassine paper, capacitor paper, and paraffin paper; stretched or unstretched films or sheets of various plastics, for example, highly heat-resistant polyesters, such as polyethylene terephthalate, polyethylene naphthalate, polybutylene terephthalate, polyphenylene sulfide, polyether ketone, and polyether sulfone, polypropylene, polycarbonate, cellulose acetate, polyethylene derivatives, polyvinyl chloride, polyvinylidene chloride, polystyrene, polyamide, polymethylpentene, and ionomers; and laminate films of a combination of the above materials.

The thickness of the substrate film may be properly varied depending upon materials for the substrate film so that the substrate film has proper strength, heat resistance or other properties. In general, however, the thickness is preferably about 1 to 100 μm.

In the present invention, the thermo-fusible fluorescent ink layer is a layer which has been formed using one or more fluorescent agents dissolved or dispersed in a thermo-fusible vehicle and contains at least an organic fluorescent agent, which is substantially colorless upon visible light irradiation and, upon ultraviolet light irradiation, emits fluorescence of visible color, that is, a colorless fluorescent agent, and a binder resin. In the present invention, the expression "substantially colorless" means that, upon printing using the fluorescent agent, even in the case where the ground color of the printing face is any color tone, the fluorescent agent cannot be visually perceived under visible light without difficulty and the contents of the print cannot be distinguished at all.

Various colorless fluorescent agents are known, and, in the present invention, any colorless fluorescent agent may be used without particular limitation, so far as the colorless fluorescent agent is an organic colorless fluorescent agent, and commercially available organic colorless fluorescent agents may also be usefully used. Colorless fluorescent agents are classified into organic colorless fluorescent agents and inorganic colorless fluorescent agents. In the present invention, organic colorless fluorescent agents are used. Organic colorless fluorescent agents can be compatibilized with the binder resin to render the thermo-fusible ink transparent and thus are highly invisible under visible light, and, when printing has been carried out using organic colorless fluorescent agents, during use of the print in a usual manner, the provision of a fluorescent agent image for preventing the forgery is less likely to be discovered.

On the other hand, inorganic colorless fluorescent agents are solid fine particles and are insoluble in solvents, resins or the like. Therefore, when a coating is formed using a mixture of the inorganic colorless fluorescent agent with a binder resin and a solvent, light scattering among particles occurs and, consequently, the coating is in many cases seen whitely and is low in the level of colorless, transparency, and invisibility under visible light. Accordingly, if the inorganic colorless fluorescent agent is used, the ground color of the printing face is hided by the inorganic colorless fluorescent agent even under visible light, and the provision of a fluorescent agent image for preventing the forgery is likely to be discovered during use of the print in a usual manner. For the above reason, organic colorless fluorescent agents are used in the present invention.

The thermo-fusible fluorescent ink layer is formed of a thermo-fusible fluorescent ink produced by dissolving or dispersing a colorless fluorescent agent in a thermally transferable vehicle composed mainly of a thermo-fusible binder resin, and the colorless fluorescent agent contained in the thermo-fusible fluorescent ink, together with the vehicle, is thermally transferred onto the printing face.

Among commercially available colorless fluorescent inks, those using organic colorless fluorescent agents may be useful as the thermo-fusible fluorescent ink. For example, R-50 manufactured by Sinloihi Co., Ltd. may be mentioned as a red-emitting fluorescent ink, R-70 manufactured by Sinloihi Co., Ltd. may be mentioned as a green-emitting fluorescent ink, and MR-30 manufactured by Sinloihi Co., Ltd. may be mentioned as a blue-emitting fluorescent ink.

The thermo-fusible fluorescent ink may also be prepared by dispersing or dissolving a commercially available organic colorless fluorescent agent in a thermo-fusible binder resin or the like. Commercially available colorless fluorescent agents include, for example, red-emitting fluorescent agents such as LC-0001 manufactured by Nippon Kayaku Co., Ltd., green-emitting fluorescent agents such as EG-502 manufactured by Mitsui Chemicals Inc., and blue-emitting fluorescent agents such as Uvitex OB manufactured by Ciba-Geigy.

The thermo-fusible binder resin and other ingredients constituting the thermally transferable vehicle, together with the organic colorless fluorescent agent, are transferred onto the printing face and thus preferably have the highest possible transparency from the viewpoint of avoiding a reduction in visibility of the image in the printed face. In particular, the thermo-fusible binder resin as the main component of the vehicle is preferably substantially colorless and transparent under visible light.

The thermo-fusible binder resin used is highly transparent and can be melted and fused at the heating temperature in the thermal transfer process to the printing face. Specific examples thereof include polyester resins, polystyrene resins, acrylic resins, polyurethane resins, acrylated urethane resins, vinyl chloride resins, vinyl acetate resins, vinyl chloride/vinyl acetate copolymer resins, polyamide resins, the above resins modified with silicone, and mixtures of the above resins.

If necessary, other ingredients may be incorporated into the thermo-fusible fluorescent ink layer. For example, the incorporation of inorganic fine particles of silica or the like into the thermo-fusible fluorescent ink layer can improve the transferability of the ink layer.

The content ratio of the colorless fluorescent agent to the binder resin in the thermo-fusible fluorescent ink layer may be properly determined according to required properties. The intensity of the fluorescent color emitted upon ultraviolet light irradiation depends upon the content of the colorless fluorescent agent. Therefore, the higher the content of the colorless fluorescent agent, the higher the vividness of the rendered color. Since, however, colorless fluorescent agents are more expensive than conventional colorants, the use of these colorless fluorescent agents in an unnecessarily large amount is uneconomical. Further, when the colorless fluorescent agent does not have high compatibility with the binder resin, excessively increasing the content of the colorless fluorescent agent poses a problem such as precipitation of the colorless fluorescent agent in the thermo-fusible fluorescent ink layer. For the above reason, the content of the colorless fluorescent agent in the thermo-fusible fluorescent ink is preferably about 0.01 to 50% by weight, particularly preferably about 0.1 to 20% by weight, based on the whole thermo-fusible fluorescent ink, and the content of the binder resin is preferably about 50 to 99.99% by weight, particularly preferably about 80 to 99.9% by weight, based on the whole thermo-fusible fluorescent ink.

The thickness of the thermo-fusible fluorescent ink layer is generally 0.2 to 5 μm, preferably 0.4 to 3 μm. When the thickness of the thermo-fusible fluorescent ink layer is less than 0.2 μm, the level of the evenness of the layer thickness is lowered leading to uneven color development. On the other hand, when the thickness of the thermo-fusible fluorescent ink layer exceeds 5 μm, the layer transferability is deteriorated, leading to a fear of the thermo-fusible fluorescent ink layer being transferred also onto a region other than the desired region.

The thermo-fusible fluorescent ink layer may be formed on the substrate film by dissolving or dispersing the colorless fluorescent agent, the binder resin and optionally other ingredients in a single solvent or a mixed solvent composed of two or more solvents selected from toluene, methyl ethyl ketone, ethyl acetate, isopropanol and the like to prepare a coating liquid, coating the coating liquid onto the substrate film by a conventional method, such as gravure coating, gravure reverse coating, or roll coating, and drying the coating.

Alternatively, the thermo-fusible fluorescent ink layer may be formed by heat melting a coating material comprising the colorless fluorescent agent, the thermo-fusible binder resin, and optionally other ingredients, instead of the dissolution of the coating material in the solvent, and coating the melt onto the substrate film by a conventional method, such as thermo-fusible coating, hot lacquer coating, gravure coating, gravure reverse coating, or roll coating, and cooling the coating.

In the thermal transfer sheet used in the first method according to the present invention, in addition to the thermo-fusible fluorescent ink layer, colorant layers of yellow, magenta, cyan, black and the like may be provided in a face serial manner. Sublimable dye-containing dye layers and thermo-fusible ink layers may be used as the colorant layer.

The dye layer is formed of a sublimable dye dissolved or dispersed in a non-transferable vehicle composed mainly of a non-thermo-fusible binder resin, and only the sublimable dye contained in the dye layer can be thermally transferred onto the printing face. Since the sublimable dye is highly transparent, even in the case where a fluorescent color image is first formed in the printing face in its image formation region followed by the formation of a visible image using a sublimable dye in the identical image formation region, advantageously, the fluorescent color image is not hided by the visible image.

Sublimable dyes may be those used in the conventional thermal transfer sheets for thermal dye sublimation transfer. Specifically, examples of yellow dyes include Phorone Brilliant Yellow 6GL, PTY-52, and Macrolex Yellow 6G. Examples of red dyes include MS Red G, Macrolex Red Violet R, Ceres Red 7B, Samaron Red HBSL, and SK Rubine SEGL. Examples of blue dyes include Kayaset Blue 714, Waxoline Blue AP-FW, Phorone Brilliant Blue S-R, MS Blue 100, and Direct Blue No. 1. Further, a combination of the above sublimable dyes having respective hues can form a dye layer having any desired hue such as black.

The non-thermo-fusible binder resin and other ingredients in the dye layer may be those used in the non-transferable vehicle in a sublimatlon-type fluorescent dye layer which will be described later.

The content of the sublimable dye in the dye layer is generally about 5 to 90% by weight, preferably about 10 to 70% by weight, based on the whole dye layer. The thickness of the dye layer is generally 0.2 to 5 μm, preferably 0.4 to 2 μm.

The dye layer may be formed on the substrate film by dissolving or dispersing the sublimable dye, the binder resin and optionally other ingredients in a single solvent or a mixed solvent composed of two or more solvents selected from toluene, methyl ethyl ketone, ethyl acetate, isopropanol and the like to prepare a coating liquid, coating the coating liquid onto the substrate film by a conventional method, such as gravure coating, gravure reverse coating, or roll coating, and drying the coating.

The thermo-fusible ink layer is formed of a thermo-fusible color ink comprising a colorant, such as yellow, magenta, cyan, or black, and a thermo-fusible vehicle. The thermo-fusible vehicle is composed mainly of a thermo-fusible binder and optionally contains other ingredients. Colorants usable herein include organic or inorganic pigments and dyes.

Here yellow colorants include, for example, PY-138, PY-139, and PY-151 from the Color Index. Magenta colorants include, for example, PR-177, PR-185, and PR-208. Cyan colorants include, for example, PB-15, PB-15:1, and PB-15:6.

In particular, when a thermo-fusible black ink layer is formed, carbon black is preferably used as the black colorant. Among organic or inorganic pigments and dyes, carbon black has good properties as a recording material, such as satisfactory color density and neither discoloration nor fading upon exposure to light, heat, high temperature and the like, and thus can print high-density and clear characters and symbols.

Any of the following binders resins 1) to 5) is preferably used as the thermo-fusible binder from the viewpoint of the adhesion to the image-receiving sheet and the scratch resistance:

1) acrylic resin;

2) acrylic resin+chlorinated rubber;

3) acrylic resin+vinyl chloride/vinyl acetate copolymer resin;

4) acrylic resin+cellulosic resin; and 5) vinyl chloride/vinyl acetate copolymer resin.

Instead of the binder resin, wax or the like may be used. Further, wax and the like may be added to the above binder resin. Representative examples of waxes include microcrystalline wax, carnauba wax, and paraffin wax. Further, Fischer-Tropsh wax, various low-molecular weight polyethylene waxes, Japan wax, beeswax, spermaceti, insect wax, wool wax, shellac wax, candelilla wax, petrolatum, partially modified wax, fatty esters, fatty amides, and other various waxes may also be used.

The thermo-fusible ink layer may be formed on the substrate film by the same method as used in the formation of the thermo-fusible fluorescent ink layer, that is, by dissolving or dispersing necessary materials in a solvent to prepare a coating liquid, coating the coating liquid onto a substrate film, and drying the coating, or by heat melting necessary materials, coating the melt onto a substrate film, and cooling the coating. The thickness of the thermo-fusible ink layer is determined based on the relationship between necessary color density and heat sensitivity and is generally preferably in the range of about 0.2 to 10 μm.

In the thermal transfer sheet used in the present invention, in addition to the thermo-fusible fluorescent ink layer, a transferable protective layer may be provided in a face serial manner. After the completion of the formation of an image on the printing face, the transferable protective layer is transferred onto the image formation region. The protective layer may be formed of various resins which have hitherto been used as a protective layer for thermally transferred images. Examples of resins include polyester resins, polystyrene resins, acrylic resins, polyurethane resins, acrylated urethane resins, the above resins modified with silicone, mixtures of the above resins, ionizing radiation-curable resins, and ultraviolet screening resins.

The protective layer containing an ionizing radiation-curable resin is excellent particularly in plasticizer resistance and scratch resistance. Conventional ionizing radiation-curable resins may be used, and an example thereof is a composition which comprises a radically polymerizable polymer or oligomer and optionally a photopolymerization initiator and is crosslink-polymerizable by the application of an ionizing radiation such as electron beams or ultraviolet light.

In general, the thickness of the protective layer is preferably in the range of about 0.5 to 10 μm although the thickness varies depending upon the resin for the protective layer.

The protective layer may have a multilayer structure comprising a plurality of layers different from each other in function, and, for example, an adhesive layer may be provided on the outermost surface of the protective layer. The adhesive layer may be formed of a resin having good adhesion upon heating, for example, acrylic resin, vinyl chloride resin, vinyl acetate resin, vinyl chloride/vinyl acetate copolymer resin, polyester resin, or polyamide resin. The thickness of the adhesive layer is generally in the range of about 0.1 to 5 μm.

The transferable protective layer may be formed by dissolving or dispersing a resin for a protective layer in a single solvent or a mixed solvent composed of two or more solvents selected from toluene, methyl ethyl ketone, ethyl acetate, isopropanol and the like to prepare a coating liquid for a protective layer, coating the coating liquid onto a substrate film or a stripping layer by a conventional method, such as gravure coating, gravure reverse coating, or roll coating, and drying the coating. When the ionizing radiation-curable resin is used, after drying the coating, an ionizing radiation such as ultraviolet light or electron beams is applied to cure the coating.

When the transferable protective layer has a multilayer structure having an additional layer such as the adhesive layer, a method may be used wherein a coating liquid, for a protective layer, containing a resin for a protective layer, a thermally adhesive resin-containing coating liquid for an adhesive layer, and a coating liquid(s) for an optional additional layer(s) are previously prepared and are coated in a predetermined order onto a substrate film or a release layer followed by drying. A proper primer layer may be formed between the layers.

In order to easily transfer the thermo-fusible fluorescent ink layer, the thermo-fusible black ink layer, or the transferable protective layer from the thermal transfer sheet to the image-receiving sheet, the release layer is provided between the substrate film and these layers. The thermo-fusible fluorescent ink layer, the thermo-fusible black ink layer, or the transferable protective layer is separated at the interface of these layers and the release layer and is transferred onto the image-receiving sheet, and the release layer stays on the substrate film. This release layer is particularly effective when the substrate film has been subjected to easy-adhesion treatment (adhesion improvement treatment) such as corona discharge treatment.

The release layer may be formed of, for example, urethane resin, polyvinyl acetal resin, or a mixture of these resins. The release layer may be formed in the same manner as used in the formation of the thermo-fusible fluorescent ink layer or the transferable protective layer, that is, by dissolving or dispersing a resin for a release layer in a solvent to prepare a coating liquid and coating the coating liquid onto a substrate film by a conventional method. In general, the thickness of the release layer is preferably about 0.1 to 5 μM.

A heat-resistant layer is preferably provided on the backside of the substrate film, that is, on the substrate in its side remote from the thermo-fusible fluorescent ink layer, from the viewpoints of preventing fusing of the sheet to a heating element, such as a thermal head, improving sheet feeding, and preventing blocking of the backside to the frontside of the thermal transfer sheet according to the present invention upon winding of the sheet in a roll form.

The heat-resistant layer may be formed of, for example, a resin such as a curable silicone oil, a silicone resin, a fluororesin, an acrylic resin, or a polyvinylbutyral resin, or a cured product thereof. In some cases, surfactants or various fillers are added to the above material, for example, for regulating the slip property of the heat-resistant layer. The heat-resistant layer may be formed in the same manner as used in the formation of the thermo-fusible fluorescent ink layer or the transferable protective layer, that is, by dissolving or dispersing a material for a heat-resistant layer in a solvent to prepare a coating solution and coating the coating liquid onto a substrate film by a conventional method.

Next, a method for forming a fluorescent color image (a forgery preventive mark) using the thermal transfer sheet will be described. When the first method is carried out by thermal ink transfer, an image, which emits a plurality of fluorescent colors and/or a fluorescent color of a mixture of the plurality of fluorescent colors upon ultraviolet light irradiation, can be formed by putting one of a plurality of thermal transfer sheets, each provided with a single or two or more of thermo-fusible fluorescent ink layers, on top of a printing face so that the thermo-fusible fluorescent ink layer in the thermal transfer sheet faces the printing face in its image formation region, heating the thermo-fusible fluorescent ink layer according to information on an image to be printed to thermally transfer the thermo-fusible fluorescent ink onto the printing face in its image formation region in a dot matrix manner and in such a manner that the formed dots do not overlap with other color dots which have already been formed or are to be formed, separating the thermo-fusible fluorescent ink layer, and then successively thermally transferring the thermo-fusible fluorescent ink layer in the identical or other thermal transfer sheet in the same manner as described above onto the identical image formation region.

The first method is the so-called "area gradation," and, as shown in FIG. 1B, fluorescent inks of two or more colors are thermally transferred onto the printing face in a dot form while regulating the transferred area for each color tone and in such a manner that dots of one color do not overlap with dots of other colors. According to this method, the fluorescent color of each transferred dot is microscopically a single color. However, when the transferred area unit of each dot is satisfactorily reduced, the color is perceived by the eye of the human as a fluorescent color produced by additive color mixing of colors according to the area ratio of the color dot groups. When this method is applied to thermal ink transfer, the use of a thermal head having a resolution equal to or higher than about 150 DPI loaded in conventional thermal printers suffices for the visual perception of the additively mixed fluorescent color. The area of each dot group can be regulated by increasing or reducing any one of or both the number of dots and the area per dot.

Color tones of colorless fluorescent agents are roughly classified into three colors, red, blue, and green. According to the method of the present invention, rather than any one of these color tones, two, three or more color tones are used to form an image that emits a plurality of fluorescent colors which are indistinguishable under visible light, making it difficult to perform forgery.

According to the present invention, a higher level of forgery preventive property can be imparted. Specifically, a fluorescent color having any desired color tone including white light can be produced by mixing red, blue, and green together after properly regulating the intensity of each color. Ordinary colorants absorb visible light and emit complementary color. On the other hand, colorless fluorescent agents absorb ultraviolet light and emit fluorescence of visible color, and the color mixture follows the law of additive color mixture. Therefore, the use of a combination of colorless fluorescent agents, which emit fluorescences different from each other or one another in color tone, can freely produce fluorescent colors having a variety of color tones including white. The color tone of fluorescent colors produced by color, mixing can be infinitely varied. This can realize the formation of gradational full-color fluorescent color images. In the present invention, by virtue of these properties, a plurality of colorless fluorescent agents may be used to form an image which emits a plurality of fluorescent colors including a fluorescent color as a color mixture, and, thus, a high level of forgery preventive property can be imparted. Further, since fully copying the color tone of a fluorescent color as a certain color mixture is difficult without learning the types and blending ratio of colorless fluorescent agents used. Therefore, as compared with the use of only a colorless fluorescent agent of a single color, the level of difficulty of forgery can be significantly enhanced. In particular, the formation of a gradational full-color fluorescent color image using a combination of three primary colors, red, blue, and green is preferred because a very high level of forgery preventive property can be imparted.

Further, since the fluorescent color image produced according to the present invention is formed using a combination of a plurality of fluorescent agents, a complicate fluorescence absorption spectrum can be produced. Furthermore, when a conventional image, which can be visually perceived under visible light, is printed so as to be superimposed on the fluorescent color image formation region, a complicate ultraviolet-visible absorption spectrum or fluorescent-visible absorption spectrum can be produced in the image formation region. Accordingly, as useful forgery preventive means, a method may be adopted wherein thermal transfer is carried out using a predetermined combination of colorless fluorescent agents and optionally a predetermined colorant(s), the form of an ultraviolet-visible absorption spectrum and/or the form of a fluorescent-visible absorption spectrum are utilized as "key" information for the prevention of forgery, and the form of the ultraviolet-visible absorption spectrum and/or the form of the fluorescent-visible absorption spectrum are detected to judge whether or not the print is genuine.

Second Method for Image Formation

Thermal dye sublimation transfer sheets usable in the second method for image formation according to the present invention may be the same as the thermal transfer sheets shown in FIGS. 1A and 1B usable in the first method according to the present invention, except that the thermo-fusible fluorescent ink layer in the thermal transfer sheets shown in FIGS. 1A and 1B has been replaced with a fluorescent dye layer containing a highly sublimable colorless fluorescent agent. In this case, however, regarding the fluorescent dye layer, there is no need to thermally transfer the whole vehicle-containing dye layer. Therefore, the provision of the dye layer through a release layer on a substrate film is not required. Instead, preferably, the substrate film is subjected to adhesion improvement treatment such as corona discharge treatment of the substrate film or the interposition of a primer layer between the dye layer and the substrate, from the viewpoint of improving the adhesion between the non-transferable vehicle and the substrate film.

The fluorescent dye layer is formed by dissolving or dispersing a sublimable colorless fluorescent agent in a non-transferable vehicle and coating the solution or dispersion onto a substrate film. Upon heating, only the organic fluorescent agent can be thermally diffused from the fluorescent color transfer layer into the printing face, and the non-transferable vehicle stays on the thermal transfer sheet.

The highly sublimable organic colorless fluorescent agent may be those exemplified in the first method. The non-transferable vehicle is composed mainly of a non-thermo-fusible binder resin and optionally contains other ingredients.

The non-thermo-fusible binder resin is not fused at the heating temperature in the thermal transfer process. Specific examples of non-thermo-fusible binder resins include those commonly used as binder resins for a sublimable dye layer, for example, cellulosic resins such as ethylcellulose, hydroxyethylcellulose, hydroxypropylcellulose, methylcellulose, cellulose acetate, and cellulose acetate butyrate; vinyl resins such as polyvinyl alcohol, polyvinyl acetate, polyvinyl butyral, polyvinyl acetal, and polyvinylpyrrolidone, poly (meth)acrylamides; polyurethane resins; polyamide resins; polyester resins; and mixtures of these resins. Among them, cellulosic, vinylacetal, vinylbutyral, and polyester resins are preferred from the viewpoints of transferability of dyes and the like.

The sublimable fluorescent dye layer may optionally contain other ingredients. For example, a release agent, such as a silicone oil or polyethylene wax, may be incorporated into the sublimable fluorescent dye layer from the viewpoint of regulating friction between the fluorescent dye layer and the object or preventing blocking in a wound state.

As with the thermo-fusible fluorescent ink used in the first method, the content ratio of the colorless fluorescent agent to the binder resin in the fluorescent dye layer used in the second method may be properly determined according to properties required. The content of the colorless fluorescent agent is preferably about 0.1 to 80% by weight, particularly preferably about 1 to 50% by weight, based on the whole fluorescent dye layer. The content of the binder resin is preferably about 20 to 99.9% by weight, particularly preferably about 50 to 99% by weight, based on the whole fluorescent dye layer. The content of the colorless fluorescent agent in the fluorescent dye layer is preferably larger than the content of the colorless fluorescent agent in the thermo-fusible fluorescent ink layer. The reason for this is as follows. In the case of thermal dye sublimation transfer, the fluorescent agent in the transfer layer is not completely transferred onto the object, and a part of the fluorescent agent stays in the transfer layer. Therefore, in order to form a sharp fluorescent color image, the content of the fluorescent agent in the transfer layer should be large.

As with the thickness of the thermo-fusible fluorescent ink layer, the thickness of the fluorescent dye layer is generally 0.2 to 5 μm, preferably 0.4 to 3 μm.

The fluorescent dye layer may be formed on the substrate film by dissolving or dispersing the colorless fluorescent agent, the binder resin and optionally other ingredients in a single solvent or a mixed solvent composed of two or more solvents selected from toluene, methyl ethyl ketone, ethyl acetate, isopropanol and the like to prepare a coating liquid, coating the coating liquid onto the substrate film by a conventional method, such as gravure coating, gravure reverse coating, or roll coating, and drying the coating.

In the formation of a fluorescent image according to the second method, as described above, even when two or more colors are printed on the printing face in its identical portion so as to be superimposed on top of each other, a fluorescent full-color image having excellent scratch resistance can be produced, and the color tone of the image can be easily controlled. Further, in the second method, fluorescent printing may be carried out in a dot matrix manner as used in the first method. Also in this case, a fluorescent full-color image having excellent scratch resistance can be formed, and the color tone of the image can be easily controlled.

In the second method, particularly when a fluorescent image is formed on a printing face by thermal dye sublimation transfer using a thermal dye sublimation fluorescent dye layer, the formation of a pattern is possible. Therefore, an image can be formed which emits fluorescence as a color mixture of two or more fluorescent agents and has a gradationally smoothly changed color density. This can realize the formation of a fluorescent image which is highly difficult to forge.

Next, the thermal transfer sheet used in the present invention will be described.

First Thermal Transfer Sheet

Figure 2A:
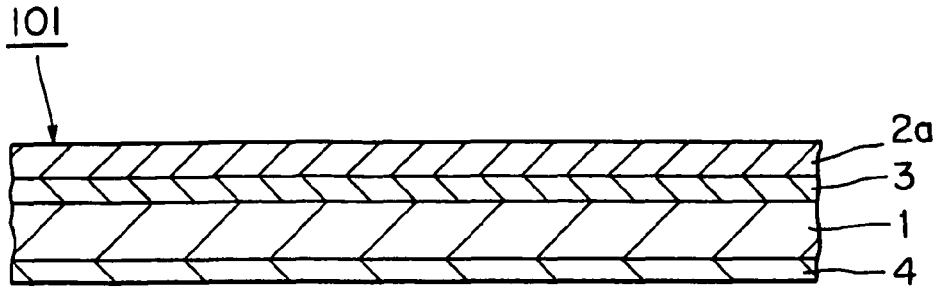
FIG. 2A is a typical cross-sectional view of one embodiment of a thermal transfer sheet usable in the method for image formation according to the present invention.
Figure 2B:
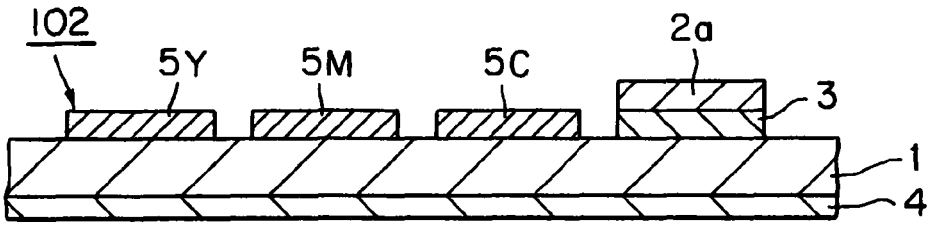
FIG. 2B is a typical cross-sectional view of one embodiment of the construction of a thermal transfer sheet usable in the method for image formation according to the present invention.

FIG. 2A is a typical cross-sectional view of one embodiment (101) of the thermal transfer sheet usable in the thermal transfer method according to the present invention. The construction of the thermal transfer sheet 101 is such that a thermo-fusible transfer fluorescent ink layer 2*a* is provided on one side of a substrate film 1 through a release layer 3 and a heat-resistant layer 4 is provided on the substrate film 1 in its side remote from the thermo-fusible transfer fluorescent ink layer 2*a*, from the viewpoints of preventing sticking to a heating element, such as a thermal head, and improving slipperiness. The thermal ink transfer fluorescent ink layer is formed by properly selecting two or more fluorescent agents from red (R), blue (B), green (G) and the like, dissolving or dispersing the two or more selected fluorescent agents in a thermo-fusible vehicle, and coating the solution or dispersion onto a substrate film. Upon heating, a mixture of a plurality of fluorescent agents, together with the ink, can be thermally transferred onto the printing face to print a fluorescent color as a color mixture.

Further, as described above, in the present invention, a method may also be adopted wherein a fluorescent color as a mixture of two or more colors is printed using a thermal transfer sheet wherein a fluorescent color transfer layer and, in addition, colorant transfer layers, such as a thermo-fusible ink layer, a thermo-fusible black ink layer, and a sublimable dye layer, and/or a transferable protective layer are provided in a face serial manner on a substrate film in an identical thermal transfer sheet. According to this method, not only a fluorescent color but also a conventional colorant, which can be visually perceived upon visible light irradiation, and/or a protective layer and the like can be transferred onto an identical printing face from one reel of a thermal transfer sheet, by providing a fluorescent color transfer layer and, in addition, a colorant transfer layer of a single color or colorant transfer layers of two or more colors and/or a transferable protective layer in a face serial manner on a substrate film in a continuous thermal transfer sheet, then reeling the continuous thermal transfer sheet in a roll form, and mounting the roll on a thermal transfer printer. This construction is effective in reducing printer size and in simplifying printer structure. When a fluorescent color image, which can be visually perceived only under ultraviolet light, together with a color image, which can be visually perceived under visible light, is formed on an identical printing face, the step of transferring a fluorescent agent using the fluorescent color transfer layer may be carried out before or after the step of transferring a colorant using the colorant transfer layer such as the thermo-fusible ink layer, the thermo-fusible black ink layer, or the sublimable dye layer. Preferably, however, the color image is printed before printing the fluorescent color image, from the viewpoint of preventing the conventional color image from hiding the fluorescent color image.

FIGS. 2B to 2E are typical cross-sectional views of embodiments (102 to 105) of the construction of the thermal transfer sheet usable in this case. The thermal transfer sheet 102 shown in FIG. 2B has a construction such that three dye layers, i.e., a dye layer containing a sublimable dye of yellow (Y), a dye layer containing a sublimable dye of magenta (M), and a dye layer containing a sublimable dye of cyan (C) (5Y, 5M, 5C), and a thermal ink transfer fluorescent ink layer 2*a* are provided in a face serial manner on one side of a substrate film 1, that is, on an identical substrate film, in parallel along the direction of feed of the film at the time of the thermal transfer. In the thermal transfer sheet 102 shown in FIG. 2B, the dye layers (5Y, 5M, 5C) are provided directly on the substrate film 1. On the other hand, the thermal ink transfer fluorescent ink layer 2*a* adjacent to the dye layers is provided on the substrate film through a release layer 3. As with the thermal transfer sheet 101 shown in FIG. 2A, in the thermal transfer sheet 102, a heat-resistant layer 4 is provided on the backside of the substrate film.

Figure 2C:
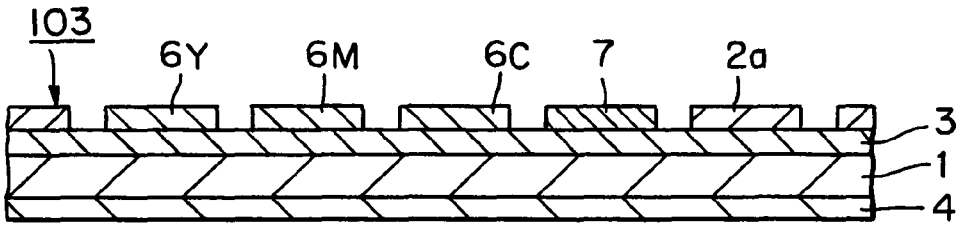
FIG. 2C is a typical cross-sectional view of another embodiment of the construction of a thermal transfer sheet usable in the method for image formation according to the present invention.

A thermal transfer sheet 103 shown in FIG. 2C has a construction such that a release layer 3 is provided on one side of a substrate film 1 and, in addition, three thermo-fusible ink layers, i.e., a thermo-fusible ink layer containing a colorant of yellow (Y), a thermo-fusible ink layer containing a colorant of magenta (M), and a thermo-fusible ink layer containing a colorant of cyan (C) (6Y, 6M, 6C), a thermo-fusible black ink layer 7, and a thermal ink transfer fluorescent ink layer 2*a* are provided in a face serial manner on the release layer 3. Further, as with the thermal transfer sheet 101 shown in FIG. 2A, in the thermal transfer sheet 103, a heat-resistant layer 4 is provided on the backside of the substrate film.

Figure 2D:
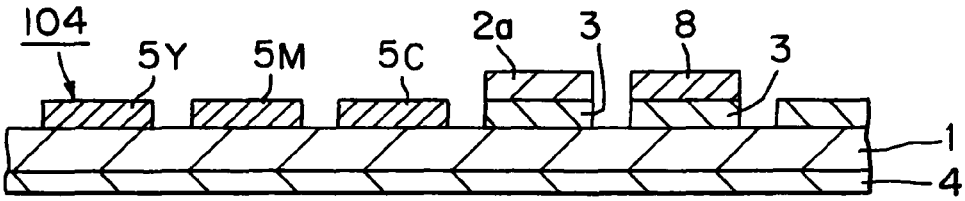
FIG. 2D is a typical cross-sectional view of still another embodiment of the construction of a thermal transfer sheet usable in the method for image formation according to the present invention.

A thermal transfer sheet 104 shown in FIG. 2D has a construction such that three dye layers, i.e., a dye layer containing a sublimable dye of yellow (Y), a dye layer containing a sublimable dye of magenta (M), and a dye layer containing a sublimable dye of cyan (C) (5Y, 5M, 5C), a thermal ink transfer fluorescent ink layer 2*a*, and a transferable protective layer 8 are provided in a face serial manner on one side of a substrate film 1. In the thermal transfer sheet 104 shown in FIG. 2D, the dye layers (5Y, 5M, 5C) are provided directly on the substrate film 1. On the other hand, the thermal ink transfer fluorescent ink layer 2*a* and the transferable protective layer 8 adjacent to the dye layers are provided on the substrate film through a release layer 3. As with the thermal transfer sheet 101 shown in FIG. 2A, in the thermal transfer sheet 104, a heat-resistant layer 4 is provided on the backside of the substrate film.

Figure 2E:
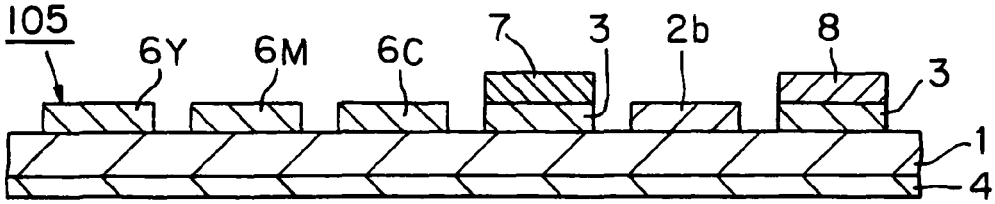
FIG. 2E is a typical cross-sectional view of a further embodiment of the construction of a thermal transfer sheet usable in the method for image formation according to the present invention.

A thermal transfer sheet 105 shown in FIG. 2E has a construction such that three dye layers, i.e., a dye layer containing a sublimable dye of yellow (Y), a dye layer containing a sublimable dye of magenta (M), and a dye layer containing a sublimable dye of cyan (C) (5Y, 5M, 5C), a thermo-fusible black ink layer 7, a thermal dye sublimation transfer fluorescent dye layer 2*b* containing two or more colorless fluorescent agents, and a transferable protective layer 8 are provided in a face serial manner on one side of a substrate film 1.

In the thermal transfer sheet 105 shown in FIG. 2E, the dye layers (5Y, 5M, 5C) and the thermal dye sublimation transfer fluorescent dye layer 2*b* are provided directly on the substrate film 1. On the other hand, the thermo-fusible black ink layer 7 and the transferable protective layer 8 adjacent to the dye layers are provided on the substrate film through a release layer 3. Further, as with the thermal transfer sheet 101 shown in FIG. 2A, in the thermal transfer sheet 105, a heat-resistant layer 4 is provided on the backside of the substrate film.

The fluorescent color transfer layer in the thermal transfer sheet 105 is the thermal dye sublimation transfer layer which has been formed by dissolving or dispersing a highly sublimable and thermally sublimation transferable organic colorless fluorescent agent in a non-transferable vehicle and coating the solution or dispersion onto a substrate film. Upon heating, only the fluorescent agent can be thermally transferred from the fluorescent color transfer layer to a printing face, and, the non-transferable vehicle stays on the thermal transfer sheet.

The dye layer is formed by dissolving or dispersing a sublimable dye, which has a color under visible light, in a non-transferable vehicle and coating the solution or dispersion onto a substrate film. Upon heating, only the dye can be thermally transferred from the dye layer onto a printing face, and the non-transferable vehicle stays on the thermal transfer sheet.

In the sublimation fluorescent color transfer layer and dye layer, there is no need to thermally transfer the whole vehicle-containing transfer layer. This can eliminate the need to provide the sublimation fluorescent color transfer layer and dye layer on the substrate film through a release layer. Instead, preferably, the substrate film is subjected to adhesion improvement treatment such as corona discharge treatment of the substrate film or the interposition of a primer layer between the fluorescent layer and dye layer and the substrate, from the viewpoint of improving the adhesion between the non-transferable vehicle and the substrate.

Next, each element constituting the first thermal transfer sheet according to the present invention will be described in detail.

The substrate film, the colorless fluorescent agent, the thermo-fusible fluorescent ink, the thermal ink transfer fluorescent ink layer, the dye layer, the sublimable dye layer, the thermo-fusible ink layer, the transferable protective layer, and the release layer constituting the first thermal transfer sheet according to the present invention may be the same as those in the thermal transfer sheet used in the above method for image formation and may be formed in the same manner as used in the formation of the thermal transfer sheet used in the above method for image formation.

The fluorescent agent transfer layer constituting the thermal transfer sheet according to the present invention is formed by dissolving or dispersing fluorescent agents in a vehicle and coating the solution or dispersion. The fluorescent agent transfer layer contains at least two or more fluorescent agents, which are substantially colorless upon visible light irradiation, but on the other hand, upon ultraviolet light irradiation, emit fluorescence of a visible color, that is, colorless fluorescent agents, and a binder resin.

The thermal ink transfer fluorescent ink layer in the fluorescent agent transfer layer is formed of a thermo-fusible fluorescent ink comprising an organic colorless fluorescent agent dissolved or dispersed in a thermally transferable vehicle composed mainly of a thermo-fusible binder resin, and the fluorescent agent in the fluorescent color transfer layer, together with the vehicle, can be thermally transferred onto a printing face.

The thermal dye sublimation transfer fluorescent dye layer is formed by dissolving or dispersing a sublimable colorless fluorescent agent in a non-transferable vehicle and coating the solution or dispersion onto a substrate film. Upon heating, only the organic fluorescent agent can be thermally diffused from the fluorescent color transfer layer to a printing face, and the non-transferable vehicle stays on the thermal transfer sheet.

Organic colorless fluorescent agents, which are highly sublimable and are usable in the thermal dye sublimation transfer, include fluorescent agents exemplified above as usable in the thermal ink transfer fluorescent ink layer. The non-transferable vehicle is composed mainly of a non-thermo-fusible binder resin and optionally contains other ingredients.

The non-thermo-fusible binder resin is not fused at the heating temperature in the thermal transfer process. Specific examples of non-thermo-fusible binder resins include those commonly used as binder resins for a sublimable dye layer, for example, cellulosic resins such as ethylcellulose, hydroxyethylcellulose, hydroxypropylcellulose, methylcellulose, cellulose acetate, and cellulose acetate butyrate; vinyl resins such as polyvinyl alcohol, polyvinyl acetate, polyvinyl butyral, polyvinyl acetal, and polyvinylpyrrolidone, poly (meth)acrylamides; polyurethane resins; polyamide resins; polyester resins; and mixtures of these resins. Among them, cellulosic, vinylacetal, vinylbutyral, and polyester resins are preferred from the viewpoints of heat resistance and transferability of dyes and the like.

The thermal dye sublimation transfer fluorescent dye layer may optionally contain other ingredients. For example, a release agent, such as a silicone oil or polyethylene wax, may be incorporated into the thermal dye sublimation transfer fluorescent dye layer from the viewpoint of regulating friction between the fluorescent dye layer and the object or preventing blocking in a wound state.

As with the thermo-fusible fluorescent ink used in the first method, the content ratio of the colorless fluorescent agent to the binder resin in the thermal dye sublimation transfer fluorescent dye layer used in the second method may be properly determined according to properties required. The content of the colorless fluorescent agent is preferably about 0.1 to 80% by weight, particularly preferably about 1 to 50% by weight, based on the whole fluorescent dye layer. The content of the binder resin is preferably about 20 to 99.9% by weight, particularly preferably about 50 to 99% by weight, based on the whole fluorescent dye layer. The content of the colorless fluorescent agent in the fluorescent dye layer is preferably larger than the content of the colorless fluorescent agent in the thermo-fusible fluorescent ink layer. The reason for this is as follows. In the case of thermal dye sublimation transfer, the fluorescent agent in the transfer layer is not completely transferred onto the object, and a part of the fluorescent agent stays in the transfer layer. Therefore, in order to form a sharp fluorescent color image, the content of the fluorescent agent in the transfer layer should be large.

In the formation of the thermal dye sublimation transfer fluorescent ink layer, the ratio between a plurality of colorless fluorescent agents incorporated is not particularly limited, and, in order to provide a desired color tone, two, three or more colorless fluorescent agents may be incorporated at any desired ratio.

As with the thickness of the thermo-fusible fluorescent ink layer, the thickness of the fluorescent dye layer is generally 0.2 to 5 μm, preferably 0.4 to 3 μm.

The fluorescent dye layer may be formed on the substrate film by dissolving or dispersing the colorless fluorescent agent, the binder resin and optionally other ingredients in a single solvent or a mixed solvent composed of two or more solvents selected from toluene, methyl ethyl ketone, ethyl acetate, isopropanol and the like to prepare a coating liquid, coating the coating liquid onto the substrate film by a conventional method, such as gravure coating, gravure reverse coating, or roll coating, and drying the coating.

In the thermal transfer sheet according to the present invention, in addition to the fluorescent color transfer layer, colorant transfer layers of yellow, magenta, cyan, black and the like may be provided in a face serial manner. Sublimable dye-containing dye layers and thermo-fusible ink layers may be used as the colorant transfer layer.

Second Thermal Transfer Sheet

Figure 3A:
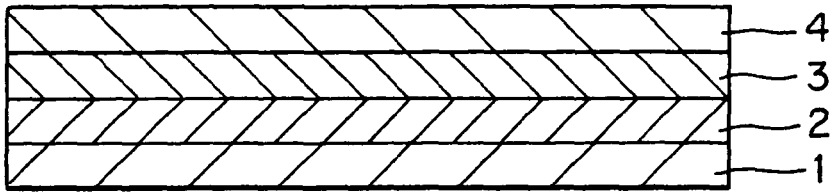
FIG. 3A is a diagram illustrating a basic form of the cross-section of a thermal transfer sheet according to the present invention.

FIG. 3A is a diagram illustrating a basic form of the cross section of the thermal transfer sheet according to the present invention. As shown in FIG. 3A, the thermal transfer sheet according to the present invention comprises a substrate film 1 and, provided on one side of the substrate film 1 in the following order, a release layer 2, an intermediate layer 3, and a heat-sensitive adhesive layer 4, both the intermediate layer 3 and the heat-sensitive adhesive layer 4 containing a fluorescent agent which emits fluorescence upon exposure to ultraviolet light.

Substrate Film:

The substrate film used in the second thermal transfer sheet according to the present invention may be any conventional substrate film which has a certain level of heat resistance and strength. For example, preferably about 0.5 to 50 μm-thick, more preferably about 3 to 10 μm-thick, papers, various converted papers, polyester films, polystyrene films, polypropylene films, polysulfone films, polycarbonate films, aramid films, polyvinyl alcohol films, and cellophane may be mentioned as the substrate film. Particularly preferred are polyester films. A heat-resistant slip layer (not shown) may be provided on the backside of the substrate film from the viewpoint of preventing fusing of a thermal head to the substrate film.

Release Layer:

A release layer for facilitating the separation of the intermediate layer and the heat-sensitive adhesive layer from the substrate film is provided on the substrate film. Examples of resins usable in the release layer include: acrylic resins; urethane resins; acrylic resins and urethane resins which have been modified with silicone; polyvinyl acetal resins; polyvinyl alcohol resins; and mixtures of the above resins. The release layer may be formed by dissolving the resin in a solvent to prepare a coating liquid, coating the coating liquid and drying the coating. The thickness of the release layer is about 0.1 to 5.0 μm.

Intermediate Layer:

The intermediate layer is a layer which is located as the uppermost layer after transfer. The intermediate layer may be formed of various resins having excellent fastness properties. Examples of resins usable in the intermediate layer include: polyester resins; polystyrene resins; acrylic resins; polyurethane resins; acrylated urethane resins; vinyl chloride resins; vinyl acetate resins; vinyl chloride/vinyl acetate copolymer resins; polyamide resins; the above resins modified with silicone; and mixtures of the above resins. The intermediate layer may be formed by dissolving or dispersing the resin and the fluorescent agent in a solvent to prepare a coating liquid, coating the coating liquid, and drying the coating. The thickness of the intermediate layer is about 0.2 to 5.0 μm. The intermediate layer is preferably colorless and transparent so that the image covered with the intermediate layer is visible.

Heat-Sensitive Adhesive Layer:

The heat-sensitive adhesive layer is a layer which permits the intermediate layer to be transferred and adhered to the surface of the image formed on the image-receiving sheet. The heat-sensitive adhesive layer is formed of the so-called "heat-sealing resin." Specific examples thereof include resins having good adhesion upon heating, such as acrylic resins, vinyl chloride resins, vinyl acetate resins, vinyl chloride/vinyl acetate copolymer resins, polyester resins, and polyamide resins. The heat-sensitive adhesive layer may be formed by dissolving or dispersing the resin and the fluorescent agent in a solvent to prepare a coating liquid, coating the coating liquid, and drying the coating. The thickness of the heat-sensitive adhesive layer is about 0.1 to 5 μm. The heat-sensitive adhesive layer is preferably colorless and transparent so that the image covered with the heat-sensitive adhesive layer is visible.

The total thickness of the intermediate layer and the heat-sensitive adhesive layer is in the range of 0.3 to 10 μm, preferably 0.4 to 5 μm. A total thickness of less than 0.3 μm causes uneven thickness which is causative of uneven fluorescent color. On the other hand, when the total thickness exceeds 10 μm, the transferability of the intermediate layer and the heat-sensitive adhesive layer (hereinafter often referred to as "fluorescent agent-containing layer") at the time of transfer is deteriorated. In this case, the transfer of the intermediate layer and the heat-sensitive adhesive layer onto only a desired region is difficult, and, in addition, the transfer of the intermediate layer and the heat-sensitive adhesive layer also onto a region other than the desired region disadvantageously occurs.

Fluorescent Agent:

A large number of conventional organic and inorganic fluorescent agents are usable as the fluorescent agent in the present invention. In the present invention, any of conventional fluorescent agents may be used. However, organic fluorescent agents, which are soluble in the resin constituting the heat-sensitive adhesive layer and the intermediate layer and are colorless under normal conditions, are preferred from the viewpoint of avoiding concealment of the image covered with the fluorescent agent-containing layer by the fluorescent agent-containing layer. Organic fluorescent agents usable herein include EB-501, EG-502, and ER-120 (all of them being tradenames) manufactured by Mitsui Chemicals Inc., EuN-0001 (tradename) manufactured by Nippon Kayaku Co., Ltd., Uvitex OB (tradename) manufactured by Ciba-Geigy, and colorless fluorescent colorants and various fluorescent brighteners manufactured by Sinloihi Co., Ltd.

The amount of the fluorescent agent added to the intermediate layer and the heat-sensitive adhesive layer may be properly determined according to properties required and is not particularly limited. When the fluorescent agent is not highly compatible with the resin for the intermediate layer and the resin for the adhesive layer, however, a high fluorescent agent content poses a problem that the fluorescent agent precipitates in the layer. For this reason, the content of the fluorescent agent is preferably about 0.01 to 50% by weight, more preferably about 0.1 to 20% by weight, based on the whole intermediate layer and heat-sensitive adhesive layer.

Image-Receiving Sheet:

The image-receiving sheet, on which an image is formed using the thermal transfer sheet according to the present invention, may be any image-receiving sheet such as paper, plastic sheet, or cloth. When a thermal transfer sheet, wherein sublimable dye layers, which will be described later, are provided in a face serial manner, is used, the image-receiving sheet in its image formation face should be dyeable with a dye. For example, in the case of a paper substrate or the like which is not dyeable with a dye, a dye-receptive layer formed of a highly dyeable polyester resin or the like is provided on the non-dyeable substrate.

Transfer Method:

In the transfer method using the thermal transfer sheet according to the present invention, the thermal transfer sheet of the present invention is put on top of an image-receiving sheet so that the surface of the heat-sensitive adhesive layer in the thermal transfer sheet faces the image-receiving sheet, followed by thermal transfer by a conventional method using a hot press, a heat roll, a thermal printer or the like. When a fluorescent agent-containing layer is transferred in a pattern form, a method may be used wherein a fluorescent agent-containing layer is previously formed in a pattern form. Alternatively, the fluorescent agent-containing layer may be transferred in a pattern form by providing a recording device, for example, a thermal printer (for example, a video printer VY-100, manufactured by Hitachi, Ltd.) and applying a heat energy regulated at about 5 to 100 mJ/mm$^2$ by controlling the recording time.

Figure 3B:
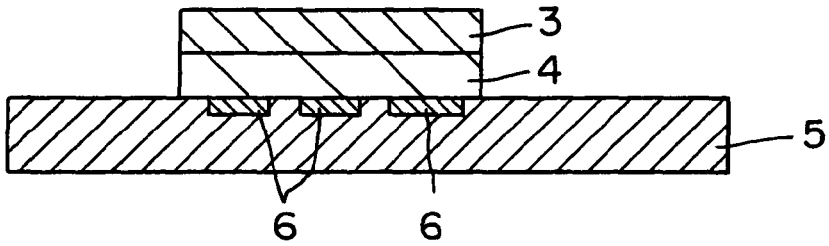
FIG. 3B is a diagram showing an embodiment of the formation of an image on an image-receiving sheet using the thermal transfer sheet according to the present invention.

In the above transfer, an image may be previously formed in the transfer region, or alternatively any image is not previously formed in the transfer region. FIG. 3B shows an embodiment wherein a single-color or full-color image 6 is previously formed on an image-receiving sheet 5 by thermal dye sublimation transfer and the fluorescent agent-containing layer is transferred so as to cover the image 6. In this image, upon the application of ultraviolet light to the fluorescent agent contained in the fluorescent agent-containing layer, the fluorescent agent emits fluorescence. This significantly changes the hue of the image 6 and thus makes it difficult to forge or alter the print.

Other Embodiments

In the present invention, a fluorescent agent is incorporated into the heat-sensitive adhesive layer and the intermediate layer. The fluorescent agent incorporated into the heat-sensitive adhesive layer may be the same as or different from the fluorescent agent incorporated into the intermediate layer. In this case, a single fluorescent agent may be used, or a mixture of two or more fluorescent agents may be used. When an identical fluorescent agent is incorporated into both the heat-sensitive adhesive layer and the intermediate layer, upon the application of ultraviolet light, high-intensity fluorescence can be emitted. On the other hand, when the fluorescent agent incorporated into the heat-sensitive adhesive layer and the fluorescent agent incorporated into the intermediate layer are different from each other in fluorescent color emitted, upon the application of ultraviolet light, fluorescence as a color mixture of the two fluorescent agents is emitted. In this case, the forgery/alteration of the print is more difficult.

Figure 3C:
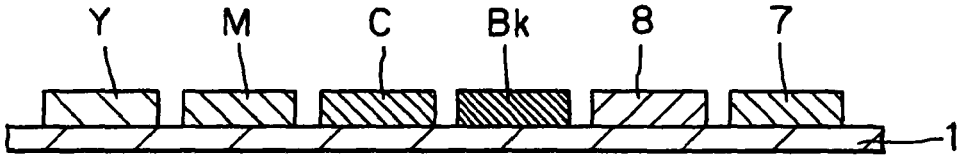
FIG. 3C is a diagram illustrating a basic form of the cross-section of another embodiment of the thermal transfer sheet according to the present invention.

In another embodiment of the present invention, as illustrated in FIG. 3C, a florescent agent-containing layer and, in addition, a single layer or a plurality of layers selected from sublimable dye layers and thermo-fusible black ink layers of at least one color selected from yellow, magenta, cyan, and black colors are formed in a face serial manner on an identical side of an identical substrate film. In the case of the thermo-fusible ink layer, the above-described release layer may be provided between the substrate film and the ink layer.

In FIG. 3C, all of the colorant layers of yellow (Y), magenta (M), cyan (C), and black (Bk) may be a sublimable dye layer comprising a sublimable dye and a binder. Alternatively, all of the colorant layers of yellow (Y), magenta (M), cyan (C), and black (Bk) may be a thermo-fusible ink layer comprising a suitable colorant and a wax or a thermoplastic resin. According to a preferred embodiment of the present invention, yellow, magenta, and cyan are sublimable dyes, a full-color gradation image is formed of these three colors, and the black layer is a thermo-fusible ink layer for the formation of a non-gradation image such as characters. Sublimable dyes, binders for the sublimable dyes, thermo-fusible materials such as wax, colorants for the thermo-fusible materials, and materials for the dye layers and the ink layers and methods for the formation of these layers usable in this embodiment are known, and the dye layer and the ink layer may be formed by the conventional method.

Further, in the present invention, as shown in FIG. 3C, a transferable protective layer 7 may be provided in a face serial relationship with the fluorescent agent-containing layer 8 on an identical side of the substrate film 1. Regarding material usable for the protective layer and methods for the formation of the protective layer, various resins commonly used as resins for protective layers may be used for the formation of the protective layer. Resins for the protective layer include, for example, polyester resins, polystyrene resins, acrylic resins, polyurethane resins, acrylated urethane resins, the above resins modified with silicone, mixtures of the above resins, and ionizing radiation-curable resins.

Figure 3D:
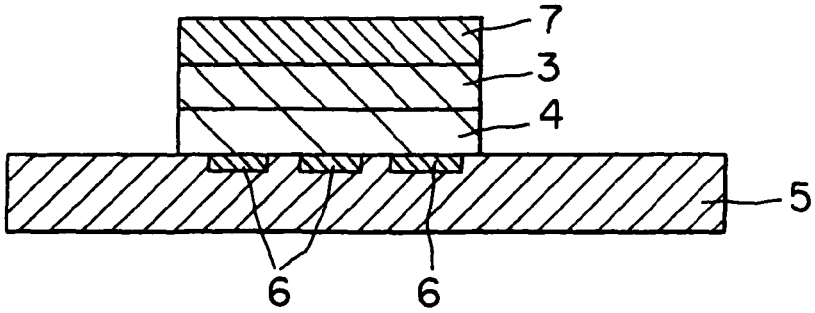
FIG. 3D is a diagram showing an embodiment of the formation of an image on an image-receiving sheet using another thermal transfer sheet according to the present invention.

The transferable protective layer may be formed by dissolving the resin in a solvent to prepare a coating liquid, coating the coating liquid, and drying the coating. The thickness of the protective layer is about 0.5 to 10 μm. FIG. 3D illustrates such a state that fluorescent agent-containing layers (heat-sensitive adhesive layer 4 and intermediate layer 3) have been transferred onto the surface of a sublimable dye image 6 followed by the transfer of a protective layer 7 onto the surface of the intermediate layer 3. The transfer of the protective layer 7 can improve various fastness properties such as weathering resistance, chemical resistance, and scratch resistance of the image 6 and the fluorescent agent-containing layers 3, 4.

Example A

Image Transfer Method According to the Present Invention

The following examples and comparative examples further illustrate the present invention. In the following description, "parts" or "%" is by weight unless otherwise specified.

Preparation of Coating Liquids

A coating liquid for a heat-resistant layer, a coating liquid for a release layer, a coating liquid for a fluorescent color transfer layer, a coating liquid for a thermo-fusible black ink layer, and a coating liquid for a protective layer were prepared according to the following formulations.

| Coating liquid for heat-resistant layer: | |
|---|---|
| Polyvinyl butyral resin (S-lec BX-1, manufactured by Sekisui Chemical Co., Ltd.) | 3.6 parts |
| Polyisocyanate (Burnock D 750, manufactured by Dainippon Ink and Chemicals, Inc.) | 8.6 parts |
| Phosphoric ester surfactant (Plysurf A 208 S, manufactured by Dai-Ichi Kogyo Seiyaku Co., Ltd.) | 2.8 parts |
| Talc (Microace P-3, manufactured by Nippon Talc Co., Ltd.) | 0.7 part |
| Methyl ethyl ketone | 32.0 parts |
| Toluene | 32.0 parts |
| Coating liquid for release layer: | |
| Urethane resin (Crisvon 9004, manufactured by DIC) | 20.0 parts |
| Polyvinyl acetoacetal resin (KS-5, manufactured by Sekisui Chemical Co., Ltd.) | 5.0 parts |
| Dimethylformamide | 80.0 parts |
| Methyl ethyl ketone | 120.0 parts |
| Coating liquid 1 for thermo-fusible fluorescent color transfer layer (red): | |
| Organic red fluorescent agent (R-50, manufactured by Sinloihi Co., Ltd.) | Whole amount |
| Coating liquid 2 for thermo-fusible fluorescent color transfer layer (green): | |
| Organic green fluorescent agent (R-70, manufactured by Sinloihi Co., Ltd.) | Whole amount |
| Coating liquid 3 for thermo-fusible fluorescent color transfer layer (blue): | |
| Organic blue fluorescent agent (MR-30, manufactured by Sinloihi Co., Ltd.) | Whole amount |
| Coating liquid 4 for sublimation fluorescent color transfer layer (red): | |
| Organic red fluorescent agent (LC-0001, manufactured by Nippon Kayaku Co., Ltd.) | 2 parts |
| Polyvinyl acetal resin (manufactured by Sekisui Chemical Co., Ltd.) | 5 parts |
| Methyl ethyl ketone | 60 parts |
| Toluene | 20.0 parts |
| Isopropanol | 10 parts |
| Coating liquid 5 for sublimation fluorescent color transfer layer (green): | |
| Organic green fluorescent agent (manufactured by Mitsui Chemicals Inc.) | 1 part |
| Polyvinyl acetal resin (manufactured by Sekisui Chemical Co., Ltd.) | 5 parts |
| Methyl ethyl ketone | 60 parts |
| Toluene | 20.0 parts |
| Isopropanol | 10 parts |
| Coating liquid 6 for sublimation fluorescent color transfer layer (blue): | |
| Organic blue fluorescent agent (Uvitex OB, manufactured by CIBA-GEIGY) | 1 part |
| Polyvinyl acetal resin (manufactured by Sekisui Chemical Co., Ltd.) | 5 parts |
| Methyl ethyl ketone | 60 parts |
| Toluene | 20.0 parts |
| Isopropanol | 10 parts |
| Coating liquid 1 for inorganic thermo-fusible fluorescent color transfer layer (red): | |
| Inorganic red fluorescent agent ($Y_2O_3$: Eu) | 0.5 part |
| Vinyl chloride-vinyl acetate copolymer resin (#1000 AKT, manufactured by Denki Kagaku Kogyo K.K.) | 100.0 parts |
| Toluene | 150.0 parts |
| Methyl ethyl ketone | 150.0 parts |
| Coating liquid 2 for inorganic thermo-fusible fluorescent color transfer layer (green): | |
| Inorganic green fluorescent agent (ZnS: Cu, Al) | 0.5 part |
| Vinyl chloride-vinyl acetate copolymer resin (#1000 AKT, manufactured by Denki Kagaku Kogyo K.K.) | 100.0 parts |
| Toluene | 150.0 parts |
| Methyl ethyl ketone | 150.0 parts |
| Coating liquid 3 for inorganic thermo-fusible fluorescent color transfer layer (blue): | |
| Inorganic blue fluorescent agent ($Ca_2B_5O_9Cl$: $Eu^{2+}$) | 0.5 part |
| Vinyl chloride-vinyl acetate copolymer resin (#1000 AKT, manufactured by Denki Kagaku Kogyo K.K.) | 100.0 parts |
| Toluene | 150.0 parts |
| Methyl ethyl ketone | 150.0 parts |
| Coating liquid for thermo-fusible black ink layer: | |
| Vinyl chloride-vinyl acetate copolymer resin solution (#1000 AKT, manufactured by Denki Kagaku Kogyo K.K.) | 20.0 parts |
| Carbon black | 10.0 parts |
| Methyl ethyl ketone/toluene (weight ratio = 1/1) | 70.0 parts |
| Coating liquid for protective layer: | |
| Vinyl chloride-vinyl acetate copolymer resin solution (#1000 AKT, manufactured by Denki Kagaku Kogyo K.K.) | 100.0 parts |
| Toluene | 150.0 parts |
| Methyl ethyl ketone | 150.0 parts |

Preparation of Substrate Film for Thermal Transfer Sheet

The coating liquid for a heat-resistant layer was gravure coated at a coverage of 0.8 g/m$^2$ on a solid basis onto one side of a 6 μm-thick polyethylene terephthalate film subjected to easy adhesion treatment, and the coating was dried to form a heat-resistant layer. The substrate film thus obtained was used to prepare thermal transfer sheets of respective examples which will be described later.

Example 1A

The coating liquid for a release layer was gravure coated at a coverage of 1 g/m$^2$ on a solid basis onto the substrate film, for a thermal transfer sheet, in its side remote from the heat-resistant layer, and the coating was dried to form a release layer. Next, the coating liquid 1 for a thermo-fusible fluorescent color transfer layer (red) was coated at a coverage of 1 g/m$^2$ onto the release layer, and the coating was dried to form a fluorescent color transfer layer. Thus, a thermo-fusible transfer sheet 1 was prepared.

A thermo-fusible transfer sheet 2 and a thermo-fusible transfer sheet 3 were prepared in the same manner as described just above, except that the coating liquid 2 for a thermo-fusible fluorescent color transfer layer (green) and the coating liquid 3 for a thermo-fusible fluorescent color transfer layer (blue) were used instead of the coating liquid 1 for the thermo-fusible fluorescent color transfer layer.

Example 1B

The coating liquid for a release layer was gravure coated at a coverage of 1 g/m$^2$ on a solid basis onto the substrate film, for a thermal transfer sheet, in its side remote from the heat-resistant layer, and the coating was dried to form a release layer. Next, the coating liquid 1 for a thermo-fusible fluorescent color transfer layer (red), the coating liquid 2 for a thermo-fusible fluorescent color transfer layer (green), and the coating liquid 3 for a thermo-fusible fluorescent color transfer layer (blue) were gravure coated in that order in a face serial manner each at a coverage of 1 g/m$^2$ on a solid basis onto the release layer, and the coatings were dried to form fluorescent color transfer layers of respective colors. Thus, a thermo-fusible transfer sheet 4 was prepared. The fluorescent color transfer layers were formed each in a length of 15 cm along the direction of flow of the substrate film while leaving a space of 1 cm between adjacent transfer layers.

Example 1C

A thermo-fusible transfer sheet 5 was prepared in the same manner as in Example 1B, except that a thermo-fusible black ink layer, together with the fluorescent color transfer layers of three colors, was formed in a face serial manner. The thermo-fusible black ink layer was formed by gravure coating the coating liquid for a thermo-fusible black ink at a position next to the fluorescent color transfer layers on the release layer at a coverage of 0.7 g/m$^2$ on a solid basis along the direction of flow of the substrate film in a length of 15 cm while leaving a space of 1 cm in the front portion and the rear portion of the thermo-fusible black ink layer.

Example 1D

A thermo-fusible transfer sheet 6 was prepared in the same manner as in Example 1B, except that a transferable protective layer, together with the fluorescent color transfer layers of three colors, was formed in a face serial manner. The transferable protective layer was formed by gravure coating the coating liquid for a protective layer at a position next to the fluorescent color transfer layers on the release layer at a coverage of 0.8 g/m$^2$ on a solid basis along the direction of flow of the substrate film in a length of 15 cm while leaving a space of 1 cm in the front portion and the rear portion of the transferable protective layer.

Example 1E

The coating liquid 4 for a sublimation fluorescent color transfer layer (red) was gravure coated at a coverage of 0.8 g/m$^2$ on a solid basis onto the substrate film, for a thermal transfer sheet, in its side remote from the heat-resistant layer, and the coating was dried to form a fluorescent color transfer layer. Thus, a thermal dye sublimation transfer sheet 7 was prepared.

A thermal dye sublimation transfer sheet 8 and a thermal dye sublimation transfer sheet 9 were prepared in the same manner as described just above, except that the coating liquid 5 for a sublimation fluorescent color transfer layer (green) and the coating liquid 6 for a sublimation fluorescent color transfer layer (blue) were used instead of the coating liquid 4 for a sublimation fluorescent color transfer layer.

Comparative Example 1A

Comparative thermo-fusible transfer sheets 1, 2, and 3 were prepared in the same manner as in Example 1A, except that the coating liquids 1, 2, and 3 for an inorganic fluorescent color transfer layer were used instead of the coating liquids 1, 2, and 3 for an organic thermo-fusible fluorescent color transfer layer.

Evaluation Methods and Results

The thermal transfer sheets prepared in the above examples and comparative examples were used to form prints by any one of the following gradation methods, and the prints were then evaluated. In all the print tests, L size paper A4 for Color Printer P-400 manufactured by Olympus Optical Co., LTD. was used as a thermal transfer image-receiving sheet.

(1) Area Gradation Image 1

A photoretouching software "Photoshop" manufactured by Adobe was used to prepare a comparative print 2 having an area gradation image 1. This area gradation image is an area gradation image by a conventional dither method, and color dots of R, G, and B have portions which have overlapped with each other or one another.

(2) Area Gradation Image 2

Next, a print 1A, a print 1B, a print 1C, a print 1D, and a comparative print 1A each having an area gradation image 2 were prepared wherein, unlike the above case, color dots of R, G, and B were formed so as not to overlap with each other.

(3) Density Gradation Image

In order to carry out the second method according to the present invention, a print 1E having a density gradation image 1 was prepared by thermal dye sublimation transfer.

Preparation of Print 1A

The thermo-fusible transfer sheet 1 prepared in Example 1A was put on top of the thermal transfer image-receiving sheet. The laminate was sandwiched between a thermal head and a platen roll, and, while pressing the laminate between the thermal head and the platen roll, energy was applied under conditions of 160 mJ/mm$^2$ and printing speed 33.3 msec/line (feed pitch 6 lines/mm). Thereafter, the two sheets were separated from each other to form an image of a colorless fluorescent agent on the thermal transfer image-receiving sheet.

Next, the area gradation image 2 including a mixed portion of the fluorescent colors was formed in the region, where the image had been formed using the thermo-fusible transfer sheet 1, in the same manner as described above, except that the thermo-fusible transfer sheet 2 and the thermo-fusible transfer sheet 3 were used. The image of colorless fluorescent agents thus obtained was substantially colorless and was difficult to visually perceive under visible light. Upon the application of commercially available black light (emission wavelength 365 nm), the image formed portion emitted substantially white light and could be clearly visually perceived. In this case, the color tone obtained was clearly different from the color tones of red, green, and blue used.

Preparation of Print 1B

The thermo-fusible transfer sheet 4 prepared in Example 1B was provided, and fluorescent colors of red, green, and blue were successively transferred onto the image-receiving sheet in its identical region under the same printing conditions as used in the preparation of the print 1A to form the area gradation image 2 including a mixed portion of the fluorescent colors.

The image of colorless fluorescent agents thus obtained was substantially colorless and was difficult to visually perceive under visible light. Upon the application of commercially available black light (emission wavelength 365 nm), the color tones of the colorless fluorescent agents used in the image formation portion were additively mixed. As a result, full-color light was emitted and could be clearly visually perceived.

Preparation of Print 1C

The thermo-fusible transfer sheet 5 prepared in Example 1C was provided. Black by the thermo-fusible black ink and fluorescent colors of red, green, and blue were successively transferred onto the image-receiving sheet in its identical region under the same printing conditions as used in the preparation of the print 1A to form characters formed of the thermo-fusible black ink and the area gradation image 1B including a mixed portion of the fluorescent colors.

For the print thus obtained, under visible light, only the back character image derived from the thermo-fusible black ink could be perceived, and the image appeared to be the same as the conventional image recorded by thermal transfer. However, upon the application of commercially available black light (emission wavelength 365 nm), the color tones of the colorless fluorescent agents were additively mixed in the fluorescent agent image formed portion. As a result, full color light was emitted and could be clearly visually perceived.

Preparation of Print 1D

The thermo-fusible transfer sheet 6 prepared in Example 1D was provided. Fluorescent colors of red, green, and blue and the transferable protective layer were successively transferred onto the image-receiving sheet in its identical region under the same printing conditions as used in the preparation of the print 1A to form the area gradation image 2 including a mixed portion of the fluorescent colors and, in addition, to cover the image with a protective layer.

The image thus obtained was substantially colorless and was difficult to visually perceive under visible light. Upon the application of commercially available black light (emission wavelength 365 nm), however, the color tones of the colorless fluorescent agents were additively mixed in the image formed portion. As a result, full color light was emitted and could be clearly visually perceived.

Preparation of Print 1E

The thermal dye sublimation transfer sheets 7, 8, and 9 prepared in Example 1E were provided. Fluorescent colors of red, green, and blue were then successively transferred onto the image-receiving sheet in its identical region under the same printing conditions as used in the preparation of the print 1A to form the area gradation image 2 including a mixed portion of the fluorescent colors.

The image thus obtained was substantially colorless and was difficult to visually perceive under visible light. Upon the application of commercially available black light (emission wavelength 365 nm), however, a full-color fluorescent image having smooth gradation as observed in images transferred by the conventional dye sublimation transfer could be visually perceived in the image formed portion.

Preparation of Comparative Print 1A

The area gradation image 2 of inorganic colorless fluorescent agents was formed under the same printing conditions as used in the preparation of the print 1A, except that the comparative thermo-fusible transfer sheets 1, 2, and 3 prepared in Comparative Example 1A were used. The image thus obtained emitted substantially white color under visible light, and the formation of some image was clearly visually perceived.

Upon the application of commercially available black light (emission wavelength 365 nm) to this image, the image formed portion emitted blue light and could be clearly visually perceived.

Preparation of Comparative Print 1B

The area gradation image 1 was formed using the comparative thermo-fusible transfer sheets 1, 2, and 3 under the same conditions as used in the preparation of the comparative print 1A. The image thus obtained emitted substantially white color under visible light, and the formation of some image was clearly visually perceived.

Upon the application of commercially available black light (emission wavelength 365 nm) to this image, in the image formed portion, the colors of R, G, and B and the color tone derived from additive color mixing could be confirmed. However, no natural full-color image could be obtained. The fluorescent image was enlarged and observed under a microscope. As a result, it was found that, in a portion where two colors or three colors of the transfer layers of R, G, and B were superimposed, the color development of the lower transfer layer in the superimposed transfer layers was weak, and, thus, the image was not seen as a natural image derived from additive color mixing. Further, upon rubbing with a finger, the portion, where the colors were superimposed, was easily separated, indicating that the image did not have scratch resistance high enough to withstand practical use.

The above tests are summarized in Table 1A below.

TABLE 1

| | Thermal transfer sheet<br>Fluorescent color coating liquid | Gradation method | Evaluation |
|---|---|---|---|
| Print 1A | Thermo-fusible transfer sheets 1, 2, and 3<br>Thermo-fusible coating liquids 1, 2, and 3 | Area gradation image 2 | Under visual light, difficult to visually perceive. Under black light, full-color fluorescent color mixed image could be visually perceived. |
| Print 1B | Thermo-fusible transfer sheet 4<br>Thermo-fusible coating liquids 1, 2, and 3 | Area gradation image 2 | |
| Print 1C | Thermo-fusible transfer sheet 5<br>Thermo-fusible coating liquids 1, 2, and 3 | Area gradation image 2 | |
| Print 1D | Thermo-fusible transfer sheet 6<br>Thermo-fusible coating liquids 1, 2, and 3 | Area gradation image 2 | |
| Print 1E | Thermal dye sublimation transfer sheets 7, 8, and 9<br>Sublimation coating liquids 4, 5, and 6 | Density gradation image 1 | Natural fluorescent gradation image could be visually perceived. |
| Comparative | Comparative thermo-fusible transfer | Area gradation | Easily visually perceived under |

TABLE 1-continued

| | Thermal transfer sheet<br>Fluorescent color coating liquid | Gradation method | Evaluation |
|---|---|---|---|
| print 1A | sheets 1, 2, and 3<br>Inorganic thermo-fusible coating liquids 1, 2, and 3 | image 2 | visual light. |
| Comparative print 1B | Comparative thermo-fusible transfer sheets 1, 2, and 3<br>Inorganic thermo-fusible coating liquids 1, 2, and 3 | Area gradation image 1 | Unnatural color development, and low scratch resistance. |

Example B

Thermal Transfer Sheet According to First Invention

Preparation of Coating Liquid

A coating liquid for a heat-resistant layer, a coating liquid for a release layer, a coating liquid for a fluorescent color transfer layer, a coating liquid for a thermo-fusible black ink layer, and a coating liquid for a protective layer were prepared according to the following formulations. All the coating liquids except for the coating liquids for fluorescent color transfer layers were the same as those in Example A.

| Coating liquid 1 for fluorescent color transfer layer: | |
|---|---|
| Organic red fluorescent agent (LC 0001, manufactured by Nippon Kayaku Co., Ltd.) | 1 part |
| Organic green fluorescent agent (EG 502, manufactured by Mitsui Chemicals Inc.) | 1 part |
| Organic blue fluorescent agent (Uvitex OB, manufactured by Ciba-Geigy) | 1 part |
| Vinyl chloride-vinyl acetate copolymer resin solution (#1000 AKT, manufactured by Denki Kagaku Kogyo K.K.) | 100.0 parts |
| Toluene | 150.0 parts |
| Methyl ethyl ketone | 150.0 parts |
| Coating liquid 2 for fluorescent color transfer layer: | |
| Inorganic red fluorescent agent ($Y_2O_3$: Eu) | 0.5 part |
| Inorganic green fluorescent agent (ZnS: Cu, Al) | 0.5 part |
| Inorganic blue fluorescent agent ($Ca_2B_5O_9Cl$: $Eu^{2+}$) | 0.5 part |
| Vinyl chloride-vinyl acetate copolymer resin solution (#1000 AKT, manufactured by Denki Kagaku Kogyo K.K.) | 100.0 parts |
| Toluene | 150.0 parts |
| Methyl ethyl ketone | 150.0 parts |
| Coating liquid 3 for fluorescent color transfer layer (single color of blue): | |
| Organic blue fluorescent agent (Uvitex OB, manufactured by Ciba-Geigy) | 1 part |
| Vinyl chloride-vinyl acetate copolymer resin solution (#1000 AKT, manufactured by Denki Kagaku Kogyo K.K.) | 100.0 parts |
| Toluene | 150.0 parts |
| Methyl ethyl ketone | 150.0 parts |
| Coating liquid 4 for fluorescent color transfer layer (single color of red): | |
| Organic red fluorescent agent (LC 0001, manufactured by Nippon Kayaku Co., Ltd.) | 1 part |
| Vinyl chloride-vinyl acetate copolymer resin solution (#1000 AKT, manufactured by Denki Kagaku Kogyo K.K.) | 100.0 parts |
| Toluene | 150.0 parts |
| Methyl ethyl ketone | 150.0 parts |

-continued

| Coating liquid 4 for fluorescent color transfer layer (single color of green): | |
|---|---|
| Organic green fluorescent agent (EG 502, manufactured by Mitsui Chemicals Inc.) | 1 part |
| Vinyl chloride-vinyl acetate copolymer resin solution (#1000 AKT, manufactured by Denki Kagaku Kogyo K.K.) | 100.0 parts |
| Toluene | 150.0 parts |
| Methyl ethyl ketone | 150.0 parts |
| Coating liquid 1 for dye layer (yellow): | |
| Disperse dye (Phorone Brilliant Yellow S-6GL) | 5.5 parts |
| Binder resin (polyvinyl acetoacetal resin KS-5, manufactured by Sekisui Chemical Co., Ltd.) | 4.5 parts |
| Polyethylene wax | 0.1 part |
| Methyl ethyl ketone | 45.0 parts |
| Toluene | 45.0 parts |
| Coating liquid 2 for dye layer (magenta): | |
| Disperse dye (MS Red) | 1.5 parts |
| Disperse dye (Macrolex Red Violet R) | 2.0 parts |
| Binder resin (polyvinyl acetoacetal resin KS-5, manufactured by Sekisui Chemical Co., Ltd.) | 4.5 parts |
| Polyethylene wax | 0.1 part |
| Methyl ethyl ketone | 45.0 parts |
| Toluene | 45.0 parts |
| Coating liquid 3 for dye layer (cyan): | |
| Disperse dye (Kayaset Blue 714) | 4.5 parts |
| Binder resin (polyvinyl acetoacetal resin KS-5, manufactured by Sekisui Chemical Co., Ltd.) | 4.5 parts |
| Polyethylene wax | 0.1 part |
| Methyl ethyl ketone | 45.0 parts |
| Toluene | 45.0 parts |

Preparation of Substrate Film for Thermal Transfer Sheet

A substrate film for a thermal transfer sheet was prepared in the same manner as in Example 1A.

Example 2A

The coating liquid for a release layer was gravure coated at a coverage of 1 g/m$^2$ on a solid basis onto the substrate film, for a thermal transfer sheet, in its side remote from the heat-resistant layer, and the coating was dried to form a release layer. Next, the coating liquid 1 for a fluorescent color transfer layer was coated at a coverage of 1 g/m$^2$ on a solid basis onto the release layer, and the coating was dried to form a fluorescent color transfer layer. Thus, a thermal transfer sheet 2A was prepared.

Example 2B

A thermal transfer sheet 2B was prepared in the same manner as in Example 2A, except that the coating liquid 2 for a fluorescent color transfer layer was used instead of the coating liquid 1 for a fluorescent color transfer layer.

Example 2C

The coating liquid 1 for a dye layer (yellow), the coating liquid 2 for a dye layer (magenta), the coating liquid 3 for a dye layer (cyan), and the coating liquid 1 for a fluorescent color transfer layer were gravure coated in that order in a face serial manner onto the substrate film, for a thermal transfer sheet, in its side remote from the heat-resistant layer, each at a coverage of 1 g/m$^2$ on a solid basis, and the coatings were dried to form dye layers of the individual colors and the fluorescent color transfer layer. Thus, a thermal transfer sheet 2C was prepared. The dye layers and the fluorescent color transfer layer were formed each in a length of 15 cm along the direction of flow of the substrate film while leaving a space of 1 cm between adjacent layers.

Example 2D

A thermal transfer sheet 2D was prepared in the same manner as in Example 2C, except that a thermo-fusible black ink layer, together with the dye layers and the fluorescent color transfer layer, was formed in a face serial manner. The coating liquid for a release layer was gravure coated onto a portion located between the dye layer (cyan) and the fluorescent color transfer layer on the surface of the substrate film at a coverage of 1 g/m$^2$ on a solid basis, and the coating was dried to form a release layer. Thereafter, the coating liquid for a thermo-fusible black ink layer was gravure coated onto the release layer at a coverage of 0.7 g/m$^2$ on a solid basis, and the coating was dried to form a thermo-fusible black ink layer. As with the other transfer layers, the multilayer structure portion composed of the release layer and the thermo-fusible black ink layer was formed along the direction of flow of the substrate film in a length of 15 cm while leaving a space of 1 cm in the front portion and the rear portion of the multilayer structure portion.

Example 2E

A thermal transfer sheet 2E was prepared in the same manner as in Example 2C, except that a transferable protective layer, together with the dye layers and the fluorescent color transfer layer, was formed in a face serial manner. The coating liquid for a release layer was gravure coated onto a portion located next to the fluorescent color transfer layer on the surface of the substrate film at a coverage of 1 g/m$^2$ on a solid basis, and the coating was dried to form a release layer. Thereafter, the coating liquid for a protective layer was gravure coated onto the release layer at a coverage of 0.8 g/m$^2$ on a solid basis, and the coating was dried to form a transferable protective layer. As with the other transfer layers, the multilayer structure portion composed of the release layer and the transferable protective layer was formed along the direction of flow of the substrate film in a length of 15 cm while leaving a space of 1 cm in the front portion and the rear portion of the multilayer structure portion.

Comparative Example 2A

A comparative thermal transfer sheet 2F was prepared in the same manner as in Example 2A, except that the coating liquid 3 for a fluorescent color transfer layer (single color of blue) was used instead of the coating liquid 1 for a fluorescent color transfer layer.

Comparative Example 2B

A comparative thermal transfer sheet 2G was prepared in the same manner as in Example 2A, except that the coating liquid 4 for a fluorescent color transfer layer (single color of red) was used instead of the coating liquid 1 for a fluorescent color transfer layer.

Comparative Example 2C

A comparative thermal transfer sheet 2H was prepared in the same manner as in Example 2A, except that the coating liquid 5 for a fluorescent color transfer layer (single color of green) was used instead of the coating liquid 1 for a fluorescent color transfer layer.

Evaluation Methods and Results

The thermal transfer sheets prepared in the above examples and comparative examples were used to form prints under the following conditions, and the prints were then evaluated. In all the print tests, L size paper A4 for Color Printer P-400 manufactured by Olympus Optical Co., LTD. was used as a thermal transfer image-receiving sheet.

Preparation of Print 2A

The thermal transfer sheet 2A prepared in Example 2A was put on top of the thermal transfer image-receiving sheet. The laminate was sandwiched between a thermal head and a platen roll, and, while pressing the laminate between the thermal head and the platen roll, energy was applied under conditions of 160 mJ/mm$^2$ and printing speed 33.3 msec/line (feed pitch 6 lines/mm). Thereafter, the two sheets were separated from each other to form an image of a colorless fluorescent agent on the thermal transfer image-receiving sheet.

The image of colorless fluorescent agents thus obtained was substantially colorless and was difficult to visually perceive under visible light. Upon the application of commercially available black light (emission wavelength 365 nm), however, the image formed portion emitted substantially white light and could be clearly visually perceived.

Preparation of Print 2B

The thermal transfer sheet 2B prepared in Example 2B was provided, and an image of the colorless fluorescent agents was formed on the thermal transfer image-receiving sheet under the same printing conditions as used in the preparation of the print 2A.

The image of colorless fluorescent agents thus obtained was substantially white under visible light, and the presence of the printed image could be perceived at some viewing angle. In this case, however, it was difficult to perceive the detailed fine pattern and the like. Upon the application of commercially available black light (emission wavelength 365 nm) to this fluorescent color image, the image formed portion emitted substantially white light and could be clearly visually perceived.

Preparation of Print 2C

The thermal transfer sheet 2C prepared in Example 2C was provided, and sublimable dyes of yellow, magenta, and cyan and a fluorescent color as a mixed color were successively transferred onto the image-receiving sheet in its identical region to form a visible image and a fluorescent color image.

The thermal transfer sheet 2C was put on top of the thermal transfer image-receiving sheet. The laminate was sandwiched between a thermal head and a platen roll, and, while pressing the laminate between the thermal head and the platen roll, printing of Y, M, and C was carried out by applying energy from the backside of the thermal transfer sheet 3 under conditions of head applied voltage 12.0 V, pulse width 16 msec, printing period 33.3 msec, and dot density 6 dots/line to form a full-color image. Thereafter, an image of colorless fluorescent agents was formed in the identical image formation region under the same printing conditions as used in the preparation of the print 1.

For the image thus obtained, only the full-color image derived from the sublimable dyes could be perceived under visible light, and the image appeared to be the same as the conventional image recorded by thermal transfer. Upon the application of commercially available black light (emission wavelength 365 nm) to this image, however, the image formed portion emitted substantially white light and could be clearly visually perceived.

Preparation of Print 2D

The thermal transfer sheet 2D prepared in Example 2D was provided, and sublimable dyes of yellow, magenta, and cyan, a thermo-fusible black ink, and a fluorescent color as a mixed color were successively transferred onto the image-receiving sheet in its identical region to form a full-color visible image, a black character image, and a fluorescent color image.

The thermal transfer sheet 2D was put on top of the thermal transfer image-receiving sheet. Printing of Y, M, and C was carried out under the same printing conditions as used in the preparation of the print 2C to form a full-color image. Thereafter, the thermo-fusible black ink was printed in the identical image formation region under conditions of 120 mJ/mm$^2$ and printing speed 33.3 msec/line (feed pitch 6 lines/mm) to form a black character image. An image of colorless fluorescent agents was then formed in the identical image formation region under the same printing conditions as used in the preparation of the print 1.

For the image thus obtained, only the full-color image derived from the sublimable dyes and the black character image derived from the thermo-fusible black ink could be perceived under visible light, and the image appeared to be the same as the conventional image recorded by thermal transfer. Upon the application of commercially available black light (emission wavelength 365 nm) to this image, however, the image formed portion emitted substantially white light and could be clearly visually perceived.

Preparation of Print 2E

The thermal transfer sheet 2E prepared in Example 2E was provided, and sublimable dyes of yellow, magenta, and cyan and a fluorescent color as a mixed color were successively transferred onto the image-receiving sheet in its identical region to form a full-color visible image and a fluorescent color image, and, in addition, a protective layer was transferred onto the formed image to cover the image with the protective layer.

The thermal transfer sheet 2E was put on top of the thermal transfer image-receiving sheet. Printing of Y, M, and C was carried out under the same printing conditions as used in the preparation of the print 2C to form a full-color image. Thereafter, an image of colorless fluorescent agents was formed in the identical image formation region under the same printing conditions as used in the preparation of the print 1. A transferable protective layer was then thermally transferred under conditions of 160 mJ/mm$^2$, printing speed 33.3 msec/line (feed pitch 6 lines/mm) to cover the image with the protective layer.

For the image thus obtained, only the full-color image derived from the sublimable dyes could be perceived under visible light, and the image appeared to be the same as the conventional image recorded by thermal transfer. Upon the application of commercially available black light (emission wavelength 365 nm) to this image, however, the image formed portion emitted substantially white light and could be clearly visually perceived.

Preparation of Comparative Print 2F

An image of a colorless fluorescent agent was formed under the same printing conditions as used in the preparation of the print 2A, except that the thermal transfer sheet 2F prepared in Comparative Example 2A was used.

The image of the colorless fluorescent agent thus obtained was substantially colorless and was difficult to visually perceive under visible light, and, upon the application of commercially available black light (emission wavelength 365 nm), the image formed portion emitted blue light and could be clearly visually perceived. The color tone of the fluorescent color emitted from the image, however, was the color tone per se of the fluorescent agent incorporated into the fluorescent color transfer layer.

Preparation of Comparative Print 2G

An image of a colorless fluorescent agent was formed under the same printing conditions as used in the preparation of the print 2A, except that the thermal transfer sheet 2G prepared in Comparative Example 2B was used.

The image of the colorless fluorescent agent thus obtained was substantially colorless and was difficult to visually perceive under visible light, and, upon the application of commercially available black light (emission wavelength 365 nm), the image formed portion emitted red light and could be clearly visually perceived. The color tone of the fluorescent color emitted from the image, however, was the color tone per se of the fluorescent agent incorporated into the fluorescent color transfer layer.

Preparation of Comparative Print 2H

An image of a colorless fluorescent agent was formed under the same printing conditions as used in the preparation of the print 2A, except that the thermal transfer sheet 2H prepared in Comparative Example 2C was used.

The image of the colorless fluorescent agent thus obtained was substantially colorless and was difficult to visually perceive under visible light, and, upon the application of commercially available black light (emission wavelength 365 nm), the image formed portion emitted green light and could be clearly visually perceived. The color tone of the fluorescent color emitted from the image, however, was the color tone per se of the fluorescent agent incorporated into the fluorescent color transfer layer.

Example C

Thermal Transfer Sheet According to Second Invention

Preparation of Substrate Film 1

The following coating liquid for a heat-resistant slip layer was gravure coated on the surface of a 6 μm-thick polyester film at a coverage of 0.5 μm, and the coating was dried. Thus, a substrate film 1 was prepared.

| Coating liquid for heat-resistant slip layer: | |
|---|---|
| Polyvinyl butyral resin (S-lec BX-1, manufactured by Sekisui Chemical Co., Ltd.) | 3.6 parts |
| Polyisocyanate (Burnock D 750, manufactured by Dainippon Ink and Chemicals, Inc.) | 8.6 parts |
| Phosphoric ester surfactant (Plysurf A 208 S, manufactured by Dai-Ichi Kogyo Seiyaku Co., Ltd.) | 2.8 parts |
| Talc | 0.7 part |

-continued

| Coating liquid for heat-resistant slip layer: | |
|---|---|
| (Microace P-3, manufactured by Nippon Talc Co., Ltd.) | |
| Methyl ethyl ketone | 32.0 parts |
| Toluene | 32.0 parts |

Example 3A

A coating liquid for a release layer, a coating liquid for an intermediate layer, and a coating liquid for a heat-sensitive adhesive layer were prepared according to the following formulations. The coating liquid for a release layer, the coating liquid for an intermediate layer, and the coating liquid for a heat-sensitive adhesive layer were successively gravure coated onto the substrate film 1 in its side remote from the heat-resistant slip layer respectively at coverages of 0.5 μm, 1.0 μm, and 1.0 μm, and the coatings were dried and stacked to form a thermal transfer sheet of the present invention.

| Coating liquid for release layer: | |
|---|---|
| Silicone-modified acrylic resin (CELTOP 226, manufactured by Daicel Chemical Industries, Ltd.) | 16 parts |
| Aluminum catalyst (CELTOP CAT-A, manufactured by Daicel Chemical Industries, Ltd.) | 3 parts |
| Methyl ethyl ketone | 8 parts |
| Toluene | 8 parts |
| **Coating liquid for intermediate layer:** | |
| Acrylic resin (Thermolac LP 45 M, manufactured by Soken Chemical Engineering Co., Ltd.) | 100 parts |
| Colorless fluorescent agent (blue light emission, manufactured by Ciba-Geigy) | 1 part |
| Methyl ethyl ketone | 50 parts |
| Toluene | 50 parts |
| **Coating liquid for heat-sensitive adhesive layer:** | |
| Vinyl chloride-vinyl acetate copolymer resin (1000 A, manufactured by Denki Kagaku Kogyo K.K.) | 100 parts |
| Colorless fluorescent agent (blue light emission, manufactured by Ciba-Geigy) | 1 part |
| Toluene | 150 parts |
| Methyl ethyl ketone | 150 parts |

Example 3B

A thermal transfer sheet according to the present invention was prepared in the same manner as in Example 3A, except that only the composition of the coating liquid for a heat-sensitive adhesive layer was changed to the following composition.

| Coating liquid for heat-sensitive adhesive layer: | |
|---|---|
| Vinyl chloride-vinyl acetate copolymer resin (1000 A, manufactured by Denki Kagaku Kogyo K.K.) | 100 parts |
| Colorless fluorescent agent (green light emission, manufactured by Sinloihi Co., Ltd.) | 1 part |
| Toluene | 150 parts |
| Methyl ethyl ketone | 150 parts |

Preparation of Substrate Film 2

A coating liquid for a yellow ink layer, a coating liquid for a magenta ink layer, a coating liquid for a cyan ink layer, and a coating liquid for a black ink layer were prepared according to the following formulations, and the coating liquid for a yellow ink layer, the coating liquid for a magenta ink layer, the coating liquid for a cyan ink layer, and the coating liquid for a black ink layer were coated in a face serial manner each at a coverage of 1.0 μm on the substrate film 1 in this side remote from the heat-resistant slip layer, and the coatings were dried to form a substrate film 2.

| Coating liquid for yellow ink layer: | |
|---|---|
| Yellow dye (Macrolex Yellow 6G, C.I. Disperse Yellow 201, manufactured by Bayer) | 5.5 parts |
| Polyvinyl acetoacetal resin (S-lec KS-5, manufactured by Sekisui Chemical Co., Ltd.) | 4.5 parts |
| Methyl ethyl ketone/toluene (weight ratio = 1/1) | 89.0 parts |
| **Coating liquid for magenta ink layer:** | |
| Magenta dye (C.I. Disperse Red 60) | 5.5 parts |
| Polyvinyl acetoacetal resin (S-lec KS-5, manufactured by Sekisui Chemical Co., Ltd.) | 4.5 parts |
| Methyl ethyl ketone/toluene (weight ratio = 1/1) | 89.0 parts |
| **Coating liquid for cyan ink layer:** | |
| Cyan dye (C.I. Solvent Blue 63) | 5.5 parts |
| Polyvinyl acetoacetal resin (S-lec KS-5, manufactured by Sekisui Chemical Co., Ltd.) | 4.5 parts |
| Methyl ethyl ketone/toluene (weight ratio = 1/1) | 89.0 parts |
| **Coating liquid for black ink layer:** | |
| Carbon black | 9 parts |
| Vinyl chloride-vinyl acetate copolymer resin (1000 A, manufactured by Denki Kagaku Kogyo K.K.) | 18 parts |
| Methyl ethyl ketone/toluene (weight ratio = 1/1) | 73 parts |

Example 3C

A thermal transfer sheet of the present invention was prepared in the same manner as in Example 3A, except that the substrate film 1 was changed to the substrate film 2 and, after the formation of the black ink layer, the release layer, the intermediate layer, and the heat-sensitive adhesive layer were successively stacked by coating and drying.

Example 3D

A thermal transfer sheet of the present invention was prepared in the same manner as in Example 3B, except that the substrate film 1 was changed to the substrate film 2 and, after the formation of the black ink layer, the release layer, the intermediate layer, and the heat-sensitive adhesive layer were successively stacked by coating and drying.

Example 3E

A thermal transfer sheet of the present invention was prepared in the same manner as in Example 3D, except that, after the formation of the fluorescent agent-containing layer, a coating liquid for a release layer having the following composition and a coating liquid for a protective layer having the following composition were coated respectively at coverages of 0.5 μm and 1.0 μm, and the coatings were dried.

| Coating liquid for release layer: | |
|---|---|
| Silicone-modified acrylic resin (CELTOP 226, manufactured by Daicel Chemical Industries, Ltd.) | 16 parts |
| Aluminum catalyst (CELTOP CAT-A, manufactured by Daicel Chemical Industries, Ltd.) | 3 parts |
| Methyl ethyl ketone | 8 parts |
| Toluene | 8 parts |
| Coating liquid for protective layer: | |
| Acrylic resin (BR-85, manufactured by Mitsui Chemicals Inc.) | 50 parts |
| Vinyl chloride-vinyl acetate copolymer resin (1000 A, manufactured by Denki Kagaku Kogyo K.K.) | 50 parts |
| Methyl ethyl ketone | 25 parts |
| Toluene | 25 parts |

Example 3F

A thermal transfer sheet of the present invention was prepared in the same manner as in Example 3D, except that, after the formation of the black ink layer, a fluorescent agent-containing layer was coated onto the center portion of the film to a coating area of one-eighth of the coating area of the black ink layer.

Comparative Example 3A

A transfer sheet of Comparative Example 3A was prepared in the same manner as in Example 3A, except that only the composition of the coating liquid for a heat-sensitive adhesive layer was changed to the following composition.

| Coating liquid for heat-sensitive adhesive layer: | |
|---|---|
| Vinyl chloride-vinyl acetate copolymer resin (1000 A, manufactured by Denki Kagaku Kogyo K.K.) | 100 parts |
| Toluene | 150 parts |
| Methyl ethyl ketone | 150 parts |

Evaluation

Evaluation was carried out using a printer P-330 manufactured by Olympus Optical Co., LTD. A thermal transfer image-receiving sheet included as a set in P-330 was used as the printing paper.

1) The thermal transfer sheet prepared in Example 3A was put on top of the thermal transfer image-receiving sheet to adhere the fluorescent agent-containing layer to the thermal transfer image-receiving sheet, and the base film was then separated to form an image of the colorless fluorescent agent-containing layer on the thermal transfer image-receiving sheet. The image of the colorless fluorescent agent-containing layer was substantially colorless and was difficult to visually perceive under visible light. Upon the application of commercially available black light (emission wavelength 365 nm), the image formed portion emitted blue light and could be clearly visually perceived.

2) The thermal transfer sheet prepared in Example 3B was put on top of the thermal transfer image-receiving sheet to adhere the fluorescent agent-containing layer to the thermal transfer image-receiving sheet, and the base film was then separated to form an image of the colorless fluorescent agent-containing layer on the thermal transfer image-receiving sheet. The image of the colorless fluorescent agent-containing layer was substantially colorless and was difficult to visually perceive under visible light. Upon the application of commercially available black light (emission wavelength 365 nm), the image formed portion emitted a color light of a color mixture of blue and green and could be clearly visually perceived.

3) The thermal transfer sheet prepared in Example 3C was put on top of the thermal transfer image-receiving sheet to adhere the fluorescent agent-containing layer to the thermal transfer image-receiving sheet. Thereafter, a full-color natural picture was printed using yellow, magenta, cyan, and black colors, and an image of a colorless fluorescent agent-containing layer was formed thereon. For the image-received sheet thus obtained, under visible light, only the natural picture could be visually perceived, and the image of the colorless fluorescent agent-containing layer was substantially colorless and was difficult to visually perceive. Upon the application of commercially available black light (emission wavelength 365 nm), the image portion composed of the colorless fluorescent agent-containing layer emitted blue light and could be clearly visually perceived.

4) The thermal transfer sheet prepared in Example 3D was put on top of the thermal transfer image-receiving sheet to adhere the fluorescent agent-containing layer to the thermal transfer image-receiving sheet. Thereafter, a full-color natural picture was printed using yellow, magenta, cyan, and black colors, and an image of a colorless fluorescent agent-containing layer was formed thereon. For the image-received sheet thus obtained, under visible light, only the natural picture could be visually perceived, and the image of the colorless fluorescent agent-containing layer was substantially colorless and was difficult to visually perceive. Upon the application of commercially available black light (emission wavelength 365 nm), the image formed portion emitted a color light of a color mixture of blue and green and could be clearly visually perceived.

5) The thermal transfer sheet prepared in Example 3E was put on top of the thermal transfer image-receiving sheet to adhere the fluorescent agent-containing layer to the thermal transfer image-receiving sheet. Thereafter, a full-color natural picture was printed using yellow, magenta, cyan, and black colors, and an image of a colorless fluorescent agent-containing layer was formed thereon. Further, a protective layer was transferred thereon to cover the whole image. Under visible light, only the natural picture could be visually perceived, and the image of the colorless fluorescent agent-containing layer was substantially colorless and was difficult to visually perceive. Upon the application of commercially available black light (emission wavelength 365 nm), the image formed portion emitted a color light of a color mixture of blue and green and could be clearly visually perceived. Even rubbing of the print with an eraser several times caused neither discoloration of the image nor disappearance of the color of the image.

6) The thermal transfer sheet prepared in Example 3F was put on top of the thermal transfer image-receiving sheet to adhere the fluorescent agent-containing layer to the thermal transfer image-receiving sheet. Thereafter, a full-color natural picture was printed using yellow, magenta, cyan, and black colors, and an image of a colorless fluorescent agent-containing layer was formed on the center portion of the sheet. For the image-received sheet thus obtained, under visible light, only the natural picture could be visually perceived, and the image of the colorless fluorescent agent-containing layer was substantially colorless and was difficult to visually perceive. Upon the application of commercially available black light (emission wavelength 365 nm), the image formed portion at the center portion of the sheet emitted a color light of a color mixture of blue and green and could be clearly visually perceived.

7) The thermal transfer sheet prepared in Comparative Example 3A was put on top of the thermal transfer image-receiving sheet to adhere the fluorescent agent-containing layer to the thermal transfer image-receiving sheet, and the base film was then separated to form an image of the colorless fluorescent agent-containing layer on the thermal transfer image-receiving sheet. The image of the colorless fluorescent agent-containing layer was substantially colorless and was difficult to visually perceive under visible light. Upon the application of commercially available black light (emission wavelength 365 nm), the image formed portion emitted blue light. However, the emitted light intensity was low, and the visibility of the image was poor.

What is claimed is:

1. A method for image formation, adapted for the formation of an image that, upon exposure to ultraviolet light irradiation, emits a plurality of fluorescent colors and/or a fluorescent color as a mixture of said fluorescent colors, said method comprising:

thermally transferring two or more organic fluorescent agents by thermal dye sublimation transfer in a dot matrix manner so that formed dots do not overlap with dots of another color that have previously been formed or are to be formed, according to image information, onto an image formation region of a printing face, wherein the organic fluorescent agents are substantially colorless upon visible light irradiation, but on the other hand, emit fluorescences having mutually different color tones in a visible region upon ultraviolet irradiation.

2. The method for image formation according to claim 1, further comprising:

providing a plurality of thermal transfer sheets, one thermal transfer sheet for each of the two or more organic fluorescent agents, each thermal transfer sheet comprising one of the two or more organic fluorescent agents in a fluorescent dye layer on a surface of a substrate film;

locating one of the plurality of thermal transfer sheets onto the printing face so that the fluorescent dye layer of the thermal transfer sheet faces the image formation region of the printing face;

conducting the thermally transferring of the organic fluorescent agent by heating the fluorescent dye layer of the thermal transfer sheet located onto the printing face to thermally diffuse the organic fluorescent agent into the image formation region according to image information;

separating, by the thermal diffusion, the fluorescent dye layer from the thermal transfer sheet to thermally transfer the fluorescent dye layer onto the printing face; and then subsequently thermally diffusing the other ones of the two or more organic fluorescent agents respectively in the other ones of the plurality of thermal transfer sheets in the same manner as in the above steps onto the same image formation region on which the fluorescent dye layer has been thermally transferred.

3. The method for image formation according to claim 1, further comprising:

providing a thermal transfer sheet comprising each of the two or more organic fluorescent agents in separate, successive fluorescent dye layers on a surface of a same substrate film;

locating the thermal transfer sheet provided with the fluorescent dye layers onto the printing face so that one of the separate fluorescent dye layers of the thermal transfer sheet faces the image formation region of the printing face;

conducting the thermally transferring of the organic fluorescent agent by heating the fluorescent dye layer in the thermal transfer sheet located onto the printing face to thermally diffuse the organic fluorescent agent into the image formation region according to image information;

separating, by the thermal diffusion, the fluorescent dye layer from the thermal transfer sheet to thermally transfer the fluorescent dye layer onto the printing face; and then subsequently thermally diffusing the other ones of the organic fluorescent agents respectively in the other ones of the separate, successive fluorescent dye layers of the thermal transfer sheet in the same manner as in the above steps onto the same image formation region on which the fluorescent dye layer has been thermally transferred.

4. The method for image formation according to claim 3, wherein the thermal transfer sheet further includes on the same substrate film a colorant transfer layer containing a colorant that is visible upon visible light irradiation to provide a thermal transfer sheet comprising the separate, successive fluorescent dye layers and the colorant transfer layer on the same substrate film; and wherein the method further comprises locating the thermal transfer sheet onto the printing face of the image formation region so that the colorant transfer layer faces the image formation region of the printing face; and heating the colorant transfer layer of the thermal transfer sheet located onto the printing face to thermally transfer the colorant onto the image formation region according to image information.

5. The method for image formation according to claim 3, wherein the thermal transfer sheet further includes a thermo-fusible black ink layer containing a thermo-fusible black ink to provide a thermal transfer sheet comprising the separate, successive fluorescent dye layers and the thermo-fusible black ink layer on the same substrate film; and wherein the method further comprises locating the thermal transfer sheet onto the printing face so that the thermo-fusible black ink layer faces the image formation region of the printing face; and heating the thermo-fusible black ink layer of the thermal transfer sheet located onto the printing face to thermally transfer the thermo-fusible black ink onto the image formation region according to image information.

6. The method for image formation according to claim 3, wherein the thermal transfer sheet further includes a transferable protective layer to provide a thermal transfer sheet comprising the separate, successive fluorescent dye layers and the transferable protective layer on the same substrate film; and wherein the method further comprises locating the thermal transfer sheet onto the printing face so that the transferable protective layer faces the image formation region of the printing face; and thermally transferring the transferable protective layer of the thermal transfer sheet located onto the printing face onto the image formation region of the printing face to cover the image formation region with the protective layer.

* * * * *